US005593571A

United States Patent [19]

Heyse et al.

[11] Patent Number: 5,593,571

[45] **Date of Patent: *Jan. 14, 1997**

[54] TREATING OXIDIZED STEELS IN LOW-SULFUR REFORMING PROCESSES

[75] Inventors: John V. Heyse, Crocket; Bernard F. Mulaskey, Fairfax, both of Calif.

[73] Assignee: Chevron Chemical Company, San Francisco, Calif.

[ * ] Notice: The term of this patent shall not extend beyond the expiration date of Pat. No. 5,406,014.

[21] Appl. No.: 358,305

[22] Filed: Dec. 19, 1994

Related U.S. Application Data

[62] Division of Ser. No. 286, Jan. 4, 1993, Pat. No. 5,413,700.

[51] Int. Cl.[6] ..... C10G 35/04; C25D 11/00

[52] U.S. Cl. ..... 208/134; 208/47; 208/48 R; 585/950; 138/DIG. 6; 148/217; 427/239

[58] Field of Search ..... 208/134, 47, 48 R; 585/950; 138/DIG. 6; 148/217; 427/239

[56] References Cited

U.S. PATENT DOCUMENTS

| | | | |
|---|---|---|---|
| 1,883,630 | 10/1932 | Duff | 196/133 |
| 2,063,596 | 12/1936 | Feiler | 585/403 |
| 2,263,366 | 11/1941 | Peck et al. | 208/47 |
| 2,818,374 | 12/1957 | Certa et al. | 205/232 |
| 2,929,775 | 3/1960 | Aristoff et al. | 208/133 |
| 3,160,671 | 12/1964 | Feigelman | 585/476 |
| 3,169,000 | 2/1965 | Earnst et al. | 244/76 J |
| 3,178,321 | 4/1965 | Satterfield | 148/625 |
| 3,284,526 | 11/1966 | Frayer | 585/483 |
| 3,459,821 | 8/1969 | Engelbrecht | 585/488 |
| 3,531,394 | 9/1970 | Kuszman | 208/48 AA |
| 3,531,543 | 9/1970 | Clippinger et al. | 585/660 |
| 3,536,776 | 10/1970 | Lo | 585/636 |
| 3,584,060 | 6/1971 | Rausch | 585/434 |
| 3,607,960 | 9/1971 | Button | 585/319 |
| 3,617,359 | 11/1971 | Wakefield | 427/253 |
| 3,631,215 | 12/1971 | Clippinger et al. | 585/419 |
| 3,686,340 | 8/1972 | Patrick et al. | 585/485 |
| 3,700,745 | 10/1972 | Kovach et al. | 585/485 |
| 3,767,456 | 10/1973 | Glaski | 427/455 |
| 3,835,183 | 9/1974 | Carpenter et al. | 562/89 |
| 3,864,284 | 2/1975 | Clippinger et al. | 502/334 |
| 3,878,131 | 4/1975 | Hayes | 502/330 |
| 3,890,110 | 6/1975 | Glaski | 428/662 |
| 3,890,686 | 6/1975 | Caubet | 428/682 |
| 3,919,073 | 11/1975 | Bagnoli et al. | 208/47 |
| 3,955,935 | 5/1976 | Schockley et al. | 428/553 |
| 3,966,833 | 6/1976 | Cosyns et al. | 585/489 |
| 4,013,487 | 3/1977 | Ramqvist et al. | 148/220 |
| 4,015,950 | 4/1977 | Galland et al. | 428/648 |
| 4,017,336 | 4/1977 | Foroulis | 208/47 |
| 4,019,969 | 4/1977 | Golebiowski et al. | 205/50 |
| 4,058,452 | 11/1977 | Loboda | 208/134 |
| 4,111,763 | 9/1978 | Pryor | 205/201 |
| 4,132,743 | 1/1979 | Caster et al. | 585/403 |
| 4,161,510 | 7/1979 | Edridge | 422/197 |

(List continued on next page.)

FOREIGN PATENT DOCUMENTS

| | | |
|---|---|---|
| 0082920 | 7/1983 | European Pat. Off. . |
| 0146081 | 6/1985 | European Pat. Off. . |
| 0192059 | 8/1986 | European Pat. Off. . |
| 0351067 | 1/1990 | European Pat. Off. . |
| 0403976A2 | 12/1990 | European Pat. Off. . |
| 1521848 | 4/1969 | Germany . |
| 317303 | 8/1929 | United Kingdom . |
| 313303 | 8/1929 | United Kingdom . |
| 1054121 | 1/1967 | United Kingdom . |
| 1122017 | 7/1968 | United Kingdom . |
| 1149163 | 4/1969 | United Kingdom . |
| 1604604 | 12/1981 | United Kingdom . |
| 2162082 | 1/1986 | United Kingdom . |
| 2234530 | 2/1991 | United Kingdom . |
| WO92/15653 | 9/1992 | WIPO . |
| WO94/15896 | 7/1994 | WIPO . |

OTHER PUBLICATIONS

"Report of the Panel on High Temperature Carburization to the Subcommittee on Corrosion", May 1963 (unclear whether a publication), pp. 1–3.

Robert C. Schueler, Hydrocarbon Processing, Aug. 1972, pp. 73–76.

R. Hochman and J. H. Burson III, Proceedings Division of Refining, "*The Fundamentals of Metal Dusting*", vol. 46 (1966), pp. 331–344 (no month).

G. L. Swales, "*High Temperature Corrosion Problems in the Petroleum Refining and Petrochemical Industries*", pp. 45–82 (no date).

R. F. Hochman, "*Catastrophic Deterioration of High Temperature Alloys in Carbonaceous Atmospheres*" Proceedings of the Symposium on Properties of High Temperature Alloys, 1978, pp. 715–732 (no month).

W. P. Hettinger, Jr., C. D. Keith, J. L. Gring and J. W. Ieter, "*Hydroforming Reactions, Effect of Certain Catalyst Properties and Poisons*," Industrial and Engineering Chemistry, Apr. 1955, vol. 47, No. 4, pp. 719–730.

F. A. Prange, "*Corrosion in a Hydrocarbon Conversion System*," Corrosion, Dec. 1959, vol. 15, No. 12, pp. 13–15.

C. J. Polk, "*Evaluating Catalytic Reformer Heater Tubing After Extended High–Temperature Service*", Nat'l Assoc. of Corros. Engineers, Paper No. 50, Mar. 1980.

excerpts from NPRA (National Petroleum Refiners Assoc.), Q&A, 1981 (Questions 17 & 21). (No month).

excerpts from May 1980 Process Economics Program Report, "*Reforming for BTX*", SRI International, Report No. 129, pp. ix–xi, 62–65, 206–207.

(List continued on next page.)

*Primary Examiner*—Glenn A. Caldarola
*Assistant Examiner*—Walter D. Griffin
*Attorney, Agent, or Firm*—Burns, Doane, Swecker & Mathis

[57] ABSTRACT

A method for reforming hydrocarbons comprising coating portions of a reactor system with a material more resistant to carburization, reacting the material with metal oxides existing in the portions of the reactor system prior to coating, fixating or removing at least a portion of the oxide in the metal oxides, and reforming hydrocarbons in the reactor system under conditions of low sulfur.

48 Claims, 15 Drawing Sheets

U.S. PATENT DOCUMENTS

| | | | |
|---|---|---|---|
| 4,163,706 | 8/1979 | Horowitz et al. | 204/242 |
| 4,167,532 | 9/1979 | Walker et al. | 585/622 |
| 4,167,533 | 9/1979 | Raymond | 585/251 |
| 4,173,457 | 11/1979 | Smith | 51/309 |
| 4,179,361 | 12/1979 | Michlmayr | 208/244 |
| 4,189,613 | 2/1980 | Bjornson | 568/805 |
| 4,191,632 | 3/1980 | Cosyns et al. | 502/66 |
| 4,191,846 | 3/1980 | Farha, Jr. et al. | 585/440 |
| 4,204,997 | 5/1980 | Hobbs et al. | 548/400 |
| 4,208,302 | 6/1980 | McKay | 502/53 |
| 4,215,231 | 7/1980 | Raymond | 585/251 |
| 4,264,433 | 4/1981 | McKay | 208/113 |
| 4,268,188 | 5/1981 | Bertus et al. | 405/128 |
| 4,271,008 | 6/1981 | Vogt et al. | 208/48 R |
| 4,297,150 | 10/1981 | Foster et al. | 148/276 |
| 4,343,658 | 8/1982 | Baker et al. | 208/48 R |
| 4,350,719 | 9/1982 | Baldi | 427/253 |
| 4,385,645 | 5/1983 | Campbell et al. | 138/139 |
| 4,404,087 | 9/1983 | Reed et al. | 208/48 AA |
| 4,410,418 | 10/1983 | Kukes et al. | 208/48 R |
| 4,438,288 | 3/1984 | Imai | 585/379 |
| 4,447,316 | 5/1984 | Buss | 208/138 |
| 4,451,687 | 5/1984 | Daly et al. | 585/489 |
| 4,456,527 | 6/1984 | Buss et al. | 208/89 |
| 4,463,206 | 7/1984 | Derrien et al. | 585/483 |
| 4,467,016 | 8/1984 | Baldi | 428/595 |
| 4,471,151 | 9/1984 | Kolts | 585/651 |
| 4,488,578 | 12/1984 | Tseung et al. | 138/146 |
| 4,500,364 | 2/1985 | Krutenat | 148/242 |
| 4,507,196 | 3/1985 | Reed et al. | 208/48 AA |
| 4,511,405 | 4/1985 | Reed et al. | 106/15.05 |
| 4,529,626 | 7/1985 | Baker et al. | 427/226 |
| 4,545,893 | 10/1985 | Porter et al. | 208/48 R |
| 4,551,227 | 11/1985 | Porter et al. | 208/48 AA |
| 4,552,643 | 11/1985 | Porter et al. | 208/48 AA |
| 4,555,326 | 11/1985 | Reid | 208/48 R |
| 4,595,673 | 6/1986 | Imai et al. | 502/227 |
| 4,613,372 | 9/1986 | Porter et al. | 106/1.13 |
| 4,665,267 | 5/1987 | Barri | 585/660 |
| 4,666,583 | 5/1987 | Porter et al. | 208/48 AA |
| 4,685,427 | 8/1987 | Tassen et al. | 122/511 |
| 4,686,201 | 8/1987 | Porter et al. | 502/154 |
| 4,687,567 | 8/1987 | Porter et al. | 208/48 AA |
| 4,692,234 | 9/1987 | Porter et al. | 208/48 AA |
| 4,716,143 | 12/1987 | Imai | 502/326 |
| 4,727,216 | 2/1988 | Miller | 585/660 |
| 4,741,819 | 5/1988 | Robinson et al. | 208/65 |
| 4,743,318 | 5/1988 | Fischer et al. | 148/442 |
| 4,762,681 | 8/1988 | Tassen et al. | 420/443 |
| 4,786,625 | 11/1988 | Imai et al. | 502/326 |
| 4,795,732 | 1/1989 | Barri | 502/223 |
| 4,804,446 | 2/1989 | Lashmore et al. | 205/104 |
| 4,804,487 | 2/1989 | Reed et al. | 252/400.1 |
| 4,827,072 | 5/1989 | Imai et al. | 585/443 |
| 4,863,892 | 9/1989 | Porter et al. | 502/170 |
| 4,902,849 | 2/1990 | McKay et al. | 585/660 |
| 4,917,969 | 4/1990 | Pircher et al. | 428/685 |
| 4,925,549 | 5/1990 | Robinson et al. | 208/65 |
| 4,926,005 | 5/1990 | Olbrich et al. | 585/632 |
| 4,935,566 | 6/1990 | Dessau et al. | 208/65 |
| 4,976,932 | 12/1990 | Maeda et al. | 422/240 |
| 4,982,047 | 1/1991 | Barri et al. | 585/660 |
| 5,012,027 | 4/1991 | Abrevaya et al. | 585/443 |
| 5,015,358 | 5/1991 | Reed | 208/48 AA |
| 5,053,574 | 10/1991 | Tsutsui et al. | 585/488 |
| 5,118,028 | 6/1992 | Ogawa et al. | 228/194 |
| 5,139,814 | 8/1992 | Sugao | 427/591 |
| 5,139,914 | 8/1992 | Tomiyama et al. | 430/106.6 |
| 5,238,492 | 8/1993 | Itoh et al. | 106/436 |
| 5,242,665 | 9/1993 | Maeda et al. | 422/240 |
| 5,406,014 | 4/1995 | Heyse et al. | 585/444 |

OTHER PUBLICATIONS

Ronald G. McClung, "*Reformer Operation Improved by Feed Sulfur Removal*," Oil & Gas Journal, Oct. 8, 1990, pp. 98 & 99.

Donald M. Little, "*Catalytic Reforming*," PennWell Publishing Company, pp. 136–141, 1985 (no month).

excerpts from NPRA, Q&A, 1982 (Question 21), pp. 95–96, (no month).

W. C. Buss et al, "*New Developments in Rheniforming*," 1978 NPRA Annual Meeting, Mar. 19–21, 1978, pp. 1–5, 7–9, FIGS. 1–10.

Marie A. Freiburger et al, "*Recent Catalyst and Process Improvements in Commercial Rheniforming*," 1980 NPRA Annual Meeting, Mar. 23–25, 1980, pp. 1–12, FIGS. 1–11.

Alon Processing, Inc.; "Alonized Steels for high temperature corrosion resistance"; 1990; pp. 1–19. (No month).

Berg et al., "Catalytic LPG Dehydrogenation Fits in '80s Outlook"; Oil and Gas Journal; pp. 191–197; Nov. 1990.

Dunn, "HP In Construction"; Hydrocarbon Processing; pp. 41–42; Aug. 1991.

General Motors, "The Carbon Gradient." (no date).

Gussow et al., "Dehydrogenation Links LPG to More Octanges"; Oil and Gas Journal; pp. 96–101; Dec. 1980.

W. A. McGill and M. J. Weinbaum, "The Selection, Application and Fabrication of Alonized Systems in the Refinery Environment"; 1975; pp. 1–18. (No month).

Micron, Inc., Analytical Service Laboratory; "Report #R–8126, Alonized Steel"; Jun. 1985.

Pujado et al., "Make $C_3$–$C_4$ Olefins Selectively"; Hydrocarbon Processing; pp. 65–70; Mar. 1990.

Pujado et al., "Production of LPG Olefins by Catalytic Dehydrogenation"; Energy Progress; vol. 4, No. 3; pp. 186–191; Sep. 1984.

Pujado et al., "OGJ Report"; Oil and Gas Journal; pp. 71–74; Mar. 1983.

Shinohara, Kohchi, Shibata, Sugitani and Tsuchida; "Development of nondestructive technique for measuring carburization thickness and a new carburization–resistant alloy"; Werkstoffe und Korrosion, 1986; pp. 410–411. (No month).

Toyo Engineering Corp. and Kubota; "Coret, New Cracking Tube to Retard Coke Depositions"; Mar. 1986; pp. 1–5.

Toyo Engineering Corp. and Kubota: "Development of Double–Layer Cast Tube for Anti–Carburization and the Retarding of Coke Deposition"; pp. 1–11. (No date).

King et al., "The Production of Ethylene by the Decomposition of n–Butane; the Prevention of Carbon Formation by the Use of Chromium Plating", Transactions of the E.I.C., vol. 3, No. 1, p. 1, (1959). (No month).

Platt's International Petrochemical Report (Oct. 1993).

J. R. Bernard, "Hydrocarbons Aromatization on Platinum Alkaline Zeolites", Proceedings of the Fifth Int. Conf. Zeolites, pp. 686–695, Heydon, London (1980). (No month).

TREATING OXIDIZED STEELS IN LOW-SULFUR REFORMING PROCESSES

This application is a divisional of application Ser. No. 08/000,286 filed Jan. 4, 1993, now U.S. Pat. No. 5,413,700.

BACKGROUND OF THE INVENTION

The present invention relates to improved techniques for catalytic reforming, particularly, catalytic reforming under low-sulfur conditions. More specifically, the invention relates to the discovery and control of problems particularly acute with low-sulfur reforming processes.

Catalytic reforming is well known in the petroleum industry and involves the treatment of naphtha fractions to improve octane rating by the production of aromatics. The more important hydrocarbon reactions which occur during the reforming operation include the dehydrogenation of cyclohexanes to aromatics, dehydroisomerization of alkylcyclopentanes to aromatics, and dehydrocyclization of acyclic hydrocarbons to aromatics. A number of other reactions also occur, including the dealkylation of alkylbenzenes, isomerization of paraffins, and hydrocracking reactions which produce light gaseous hydrocarbons, e.g., methane, ethane, propane and butane. It is important to minimize hydrocracking reactions during reforming as they decrease the yield of gasoline boiling products and hydrogen.

Because there is a demand for high octane gasoline, extensive research has been devoted to the development of improved reforming catalysts and catalytic reforming processes. Catalysts for successful reforming processes must possess good selectivity. That is, they should be effective for producing high yields of liquid products in the gasoline boiling range containing large concentrations of high octane number aromatic hydrocarbons. Likewise, there should be a low yield of light gaseous hydrocarbons. The catalysts should possess good activity to minimize excessively high temperatures for producing a certain quality of products. It is also necessary for the catalysts to either possess good stability in order that the activity and selectivity characteristics can be retained during prolonged periods of operation; or be sufficiently regenerable to allow frequent regeneration without loss of performance.

Catalytic reforming is also an important process for the chemical industry. There is an increasingly larger demand for aromatic hydrocarbons for use in the manufacture of various chemical products such as synthetic fibers, insecticides, adhesives, detergents, plastics, synthetic rubbers, pharmaceutical products, high octane gasoline, perfumes, drying oils, ion-exchange resins, and various other products well known to those skilled in the art.

An important technological advance in catalytic reforming has recently emerged which involves the use of large-pore zeolite catalysts. These catalysts are further characterized by the presence of an alkali or alkaline earth metal and are charged with one or more Group VIII metals. This type of catalyst has been found to advantageously provide higher selectivity and longer catalytic life than those previously used.

Having discovered selective catalysts with acceptable cycle lives, successful commercialization seemed inevitable. Unfortunately, it was subsequently discovered that the highly selective, large pore zeolite catalysts containing a Group VIII metal were unusually susceptible to sulfur poisoning. See U.S. Pat. No. 4,456,527.

Generally, sulfur occurs in petroleum and syncrude stocks as hydrogen sulfide, organic sulfides, organic disulfides, mercaptans, also known as thiols, and aromatic ring compounds such as thiophene, benzothiophene and related compounds.

Conventionally, feeds with substantial amounts of sulfur, for example, those with more than 10 ppm sulfur, have been hydrotreated with conventional catalysts under conventional conditions, thereby changing the form of most of the sulfur in the feed to hydrogen sulfide. Then, the hydrogen sulfide is removed by distillation, stripping or related techniques.

One conventional method for removing residual hydrogen sulfide and mercaptan sulfur is the use of sulfur sorbents. See, for example, U.S. Pat. Nos. 4,204,997 and 4,163,706, the contents of which are hereby incorporated by reference. The concentration of sulfur in this form can be reduced to considerably less than 1 ppm by using the appropriate sorbents and conditions, but it has been found to be difficult to remove sulfur to less than 0.1 ppm or to remove residual thiophene sulfur. See, for example, U.S. Pat. No. 4,179,361 the contents of which is hereby incorporated by reference, and particularly Example 1 of that patent. Very low space velocities are required to remove thiophene sulfur, requiring large reaction vessels filled with sorbent. Even with these precautions, traces of thiophene sulfur still can be found.

Thus, improved methods for removing residual sulfur, and in particular, thiophene sulfur, from a hydrotreated naphtha feedstock were developed. See, for example, U.S. Pat. Nos. 4,741,819 and 4,925,549, the contents of which are hereby incorporated by reference. These alternative methods include contacting the naphtha feedstock with molecular hydrogen under reforming conditions in the presence of a less sulfur sensitive reforming catalyst, thereby converting trace sulfur compounds to $H_2S$, and forming a first effluent. The second effluent is contacted with a highly selective reforming catalyst under severe reforming conditions. Accordingly, when using the highly sulfur sensitive catalysts, those skilled in the art go to great extremes to remove sulfur from the hydrocarbon feed. By doing so, the catalyst life is extended for significant periods of time.

While low-sulfur systems using highly selective large-pore zeolite catalysts were initially effective, it was discovered that a shut down of the reactor system may be necessary after only a matter of weeks. The reactor system of one test plant had regularly become plugged after only such brief operating periods. The plugs were found to be those associated with coking. However, although coking within catalyst particles is a common problem in hydrocarbon processing, the extent and rate of coke plug formation far exceeded any expectation.

SUMMARY OF THE INVENTION

Accordingly, one object of the invention is to provide a method for reforming hydrocarbons under conditions of low sulfur which avoids the aforementioned problems found to be associated with the use of highly sensitive reforming catalysts and of low-sulfur reforming processes.

It has been surprisingly found that coke plugs in low sulfur reactor systems contained particles and droplets of metal; the droplets ranging in size of up to a few microns. This observation led to the startling realization that there are new, profoundly serious, problems which were not of concern with conventional reforming techniques where process sulfur levels are significantly higher. More particularly, it was discovered that problems existed which threatened the effective and economic operability of the systems, and the physical integrity of the equipment as well. It was also discovered that these problems emerged due to the low-sulfur conditions, and to some extent, the low levels of water.

For the last forty years, catalytic reforming reactor systems have been constructed of ordinary mild steel (e.g., 2¼ Cr 1 Mo). Over time, experience has shown that the systems can operate successfully for about twenty years without significant loss of physical strength. However, the discovery of the metal particles and droplets in the coke plugs eventually lead to an investigation of the physical characteristics of the reactor system. Quite surprisingly, conditions were discovered which are symptomatic of a potentially severe physical degradation of the entire reactor system, including the furnace tubes, piping, reactor walls and other environments such as catalysts that contain iron and metal screens in the reactors. Ultimately, it was discovered that this problem is associated with the excessive carburization of the steel which causes an embrittlement of the steel due to injection of process carbon into the metal. Conceivably, a catastrophic physical failure of the reactor system could result.

With conventional reforming techniques carburization simply is not a problem or concern; nor was it expected to be in contemporary low-sulfur/low-water systems. And, it was assumed that conventional process equipment could be used. Apparently, however, the sulfur present in conventional systems effectively inhibits carburization. Somehow in conventional processes the process sulfur interferes with the carburization reaction. But with extremely low-sulfur systems, this inherent protection no longer exists.

The problems associated with carburization only begin with carburization of the physical system. The carburization of the steel walls leads to "metal dusting"; a release of catalytically active particles and melt droplets of metal due to erosion of the metal.

The active metal particulates provide additional sites for coke formation in the system. While catalyst deactivation from coking is generally a problem which must be addressed in reforming, this new significant source of coke formation leads to a new problem of coke plugs which excessively aggravates the problem. In fact, it was found that the mobile active metal particulates and coke particles metastasize coking generally throughout the system. The active metal particulates actually induce coke formation on themselves and anywhere that the particles accumulate in the system resulting in coke plugs and hot regions of exothermic demethanation reactions.

Additionally, new reactor systems are often heat treated to remove stress. Such procedures, for example, heating in air at least 1650° F. for 1–2 hours, often produce an oxide scale up to 50 μm thick on 347 stainless and thicker on mild steels. In carburizing environments, these oxide scales reduce to finely particulate Fe, Ni metal which is extremely reactive for coking and can infect underlying steel with carburization and pitting. Thus, the use of oxidized steels in such environments and of heat treatments which result in the oxidation of such steels should be avoided.

As a result of the above reactions, an unmanageable and premature coke-plugging of the reactor system occurs which can lead to a system shut-down within weeks of start-up. Use of the process and reactor system of the present invention, however, overcomes these problems.

Therefore, another aspect of the invention relates to a method for reforming hydrocarbons comprising contacting the hydrocarbons with a reforming catalyst, preferably a large-pore zeolite catalyst including an alkali or alkaline earth metal and charged with one or more Group VIII metals, in reactor systems having oxidized surfaces.

Yet another aspect of the invention relates to a reactor system including means for providing a resistance to carburization and metal dusting which is an improvement over conventional mild steel systems in a method for reforming hydrocarbons using a reforming catalyst such as a large-pore zeolite catalyst including an alkaline earth metal and charged with one or more Group VIII metals under conditions of low sulfur, the resistance being such that embrittlement will be less than about 2.5 mm/year, preferably less than 1.5 mm/year, more preferably less than 1 mm/year, and most preferably less than 0.1 mm/year.

F. in air for 1 hour. Abundant coking occurred on the oxidized surfaces after only 2½ hours at 1200° F. in a carburizing atmosphere. The chip at right is 304 stainless steel.

Figure 9:
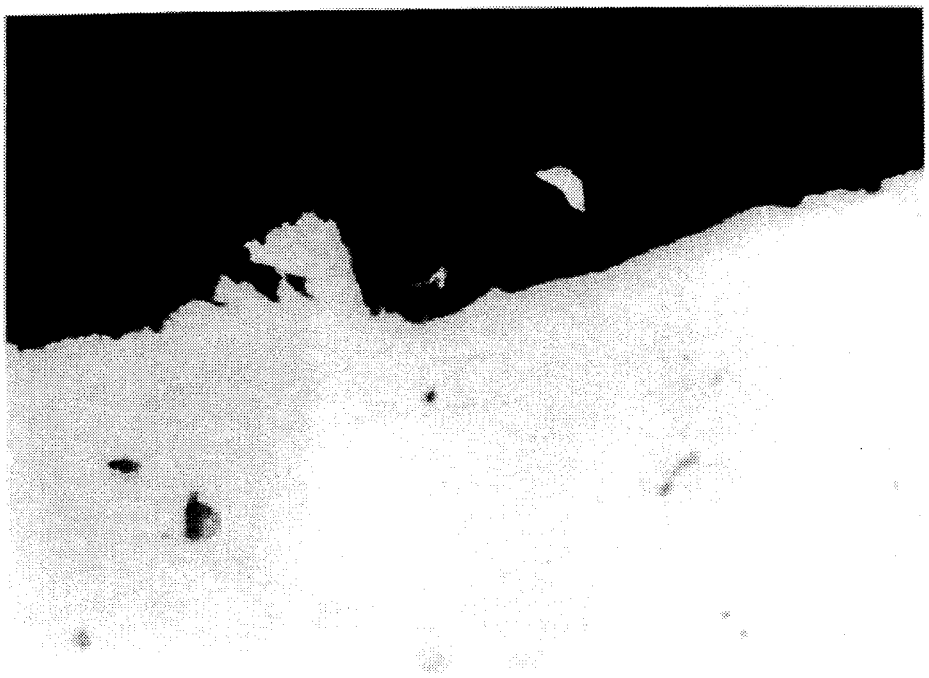

FIG. 9 is a photomicrograph (reflected light, 200×, 1 cm=50 μm) of a surface of a 347 stainless steel sample which was heat treated in an electric furnace at 1650° F. in air for 1 hour. The sample was exposed to a carburizing atmosphere at 1200° F. for 2½ hours. A metal dusting pit (center) formed on the steel surface under the actively coking oxide layer. No dusting occurred on the unoxidized surfaces.

Figure 10:
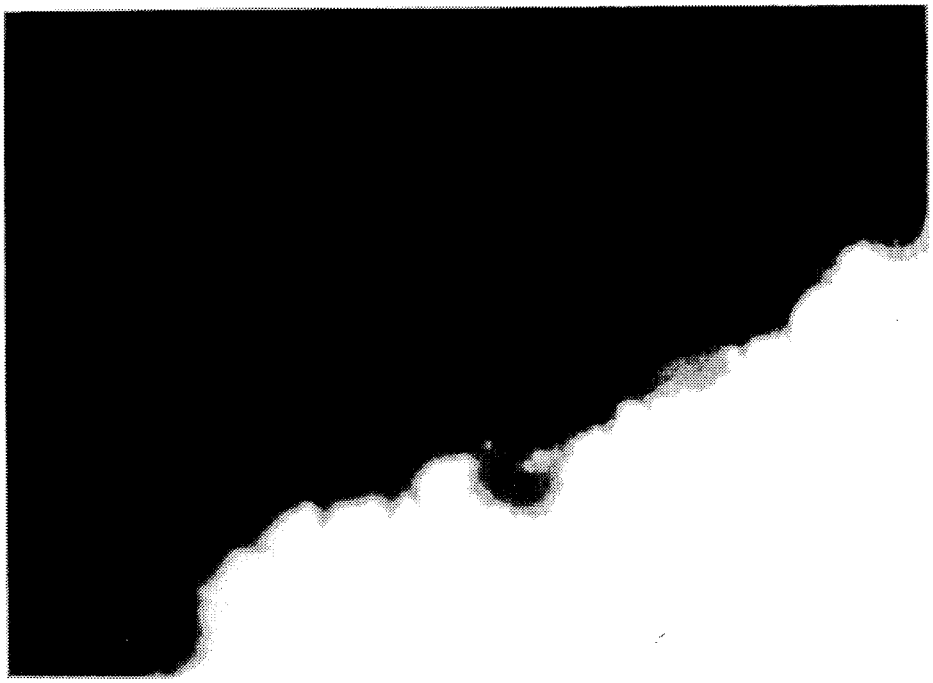

FIG. 10 is a photomicrograph (reflected light, 1250×, 1 cm=8 μm) of the surface of the 347 stainless steel sample described in FIG. 9. The sample carburized at 1200° F. along most of the surface. The chromium-rich oxide layer (gray) persisted and resisted coking.

Figure 11:
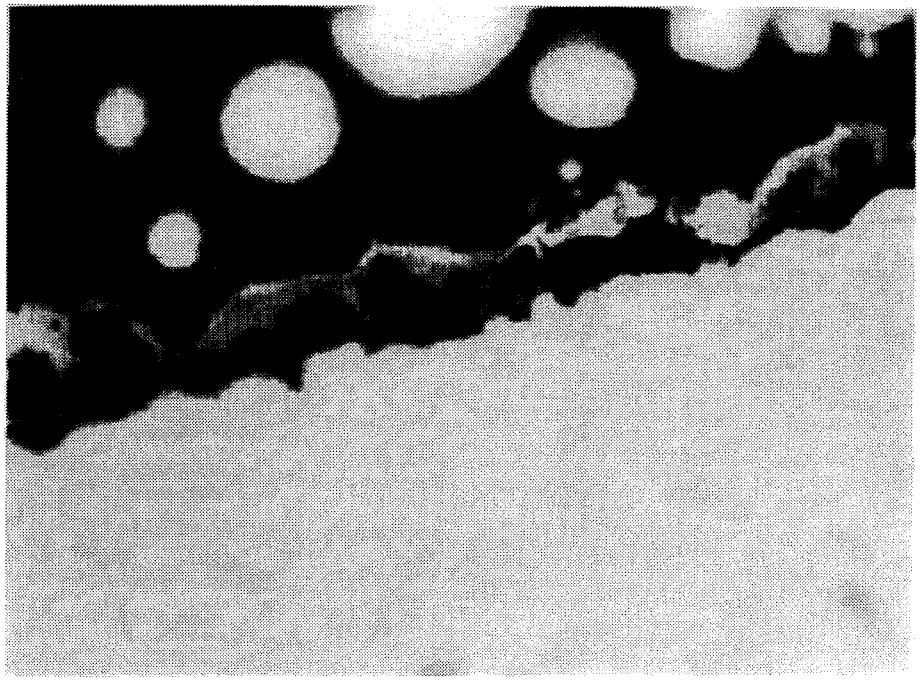

FIG. 11 is a photomicrograph (reflected light, 1250×, 1 cm=8 μm) of a surface of a 347 stainless steel sample which was heat treated in an electric furnace at 1650° F. in air for 1 hour. The sample was coated with tin paint. The ferrochromite layer and crystals (dark) persisted on the steel surface (bright, center). The magnetite layer was completely replaced by a series of iron stannides (shades of gray). Some unreacted tin spheres (bright, top) were present.

Figure 12:
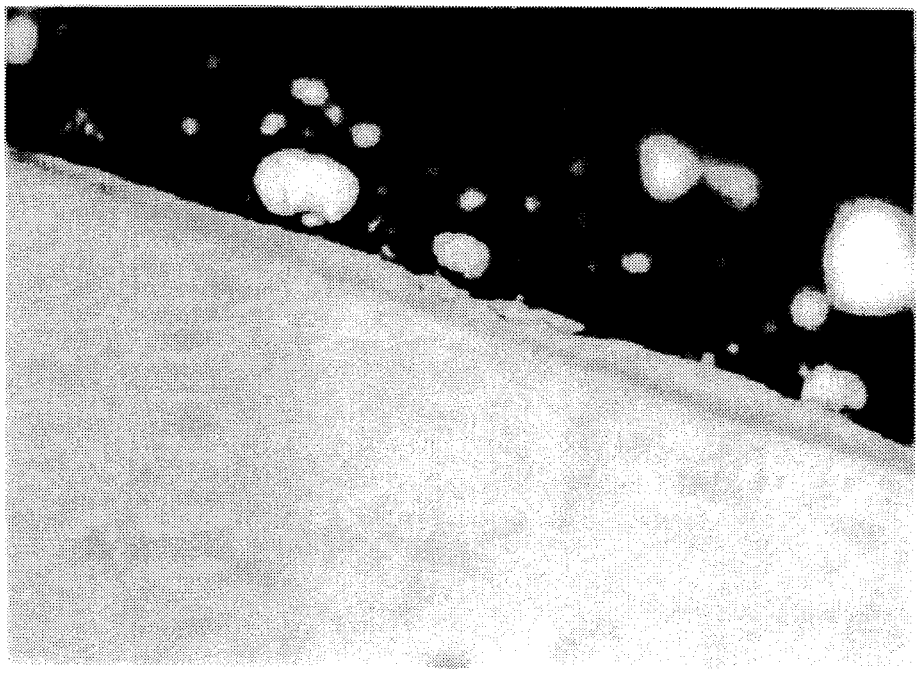

FIG. 12 is a photomicrograph (reflected light, 250×, 1 cm=8 μm) of a surface of a 347 stainless steel sample which was heat treated in an electric furnace at 1650° F. in air for 1 hour. On an unoxidized surface, a protective tin coating reacted directly with the steel to form a series of nickel iron stannides.

Figure 13:
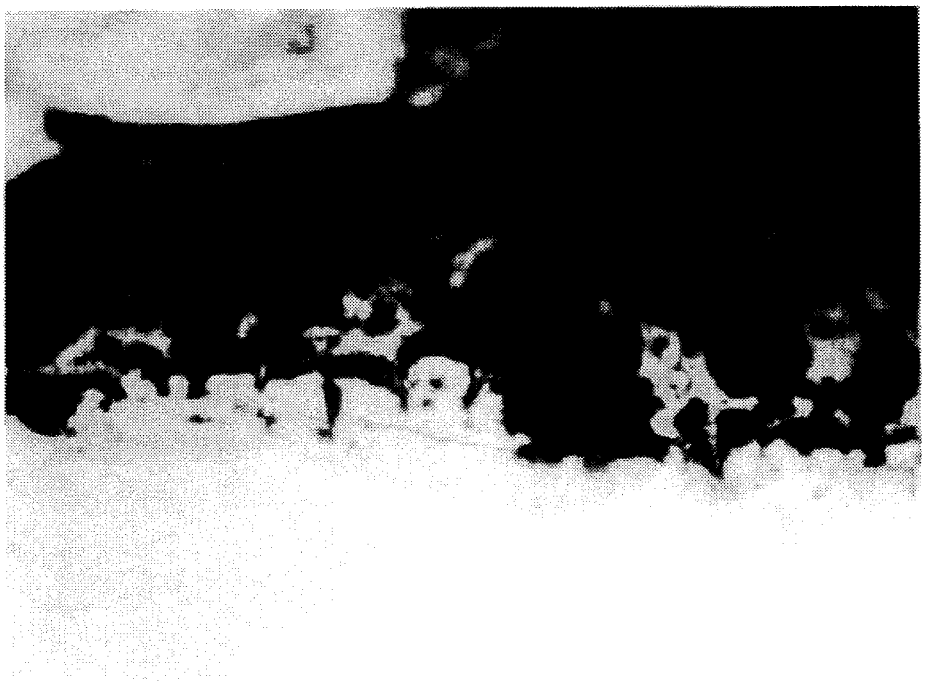

FIG. 13 is a photomicrograph (reflected light, 1250×, 1 cm=8 μm) of a surface of a 347 stainless steel sample which was heat treated in an electric furnace at 1650° F. in air for 1 hour. After two weeks of exposure to a carburizing atmosphere at 1150° F., tin in a tin containing protective coating consumed the iron in the ferrochromite layer and crystals, penetrated the chromium oxide layer, and reacted to form a continuous layer of nickel iron stannide on the underlying steel. The remaining oxide is eskolaite ($Cr_2O_3$).

Figure 14:
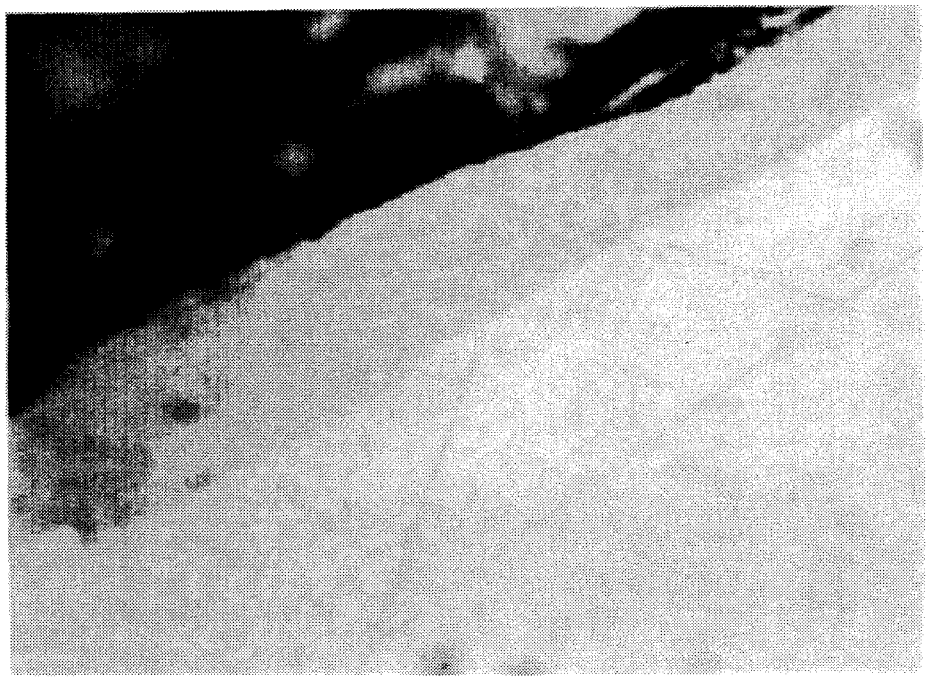

FIG. 14 is a photomicrograph (reflected light, 1250×, 1 cm=8 μm) of a surface of a 347 stainless steel sample which was heat treated in an electric furnace at 1650° F. in air for 1 hour. After two weeks at 1150° F., a thicker continuous layer of nickel iron stannide (dark) on the unoxidized surface of the steel was formed. The thin brighter layer under the stannide is the chromium-rich, nickel-poor steel layer.

Figure 15:
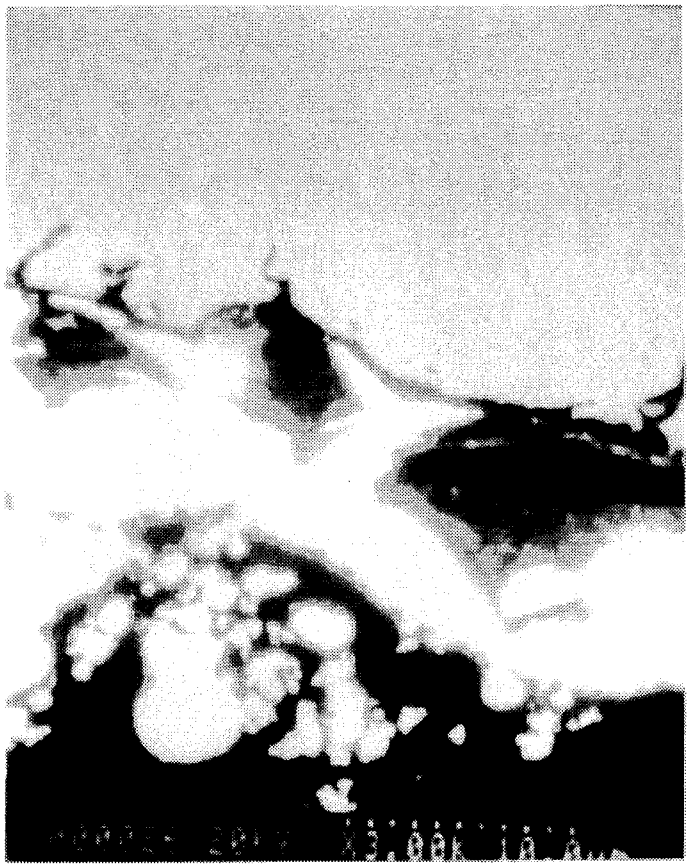

FIG. 15 is a photomicrograph (scale bar at right) of a surface of a 347 stainless steel sample which was heat treated in an electric furnace at 1650° F. in air for 1 hour. The freshly stannided sample exhibited a stannide (bright) layer on top of a ferrochromite oxide layer (dark). Steel at left.

Figure 16:
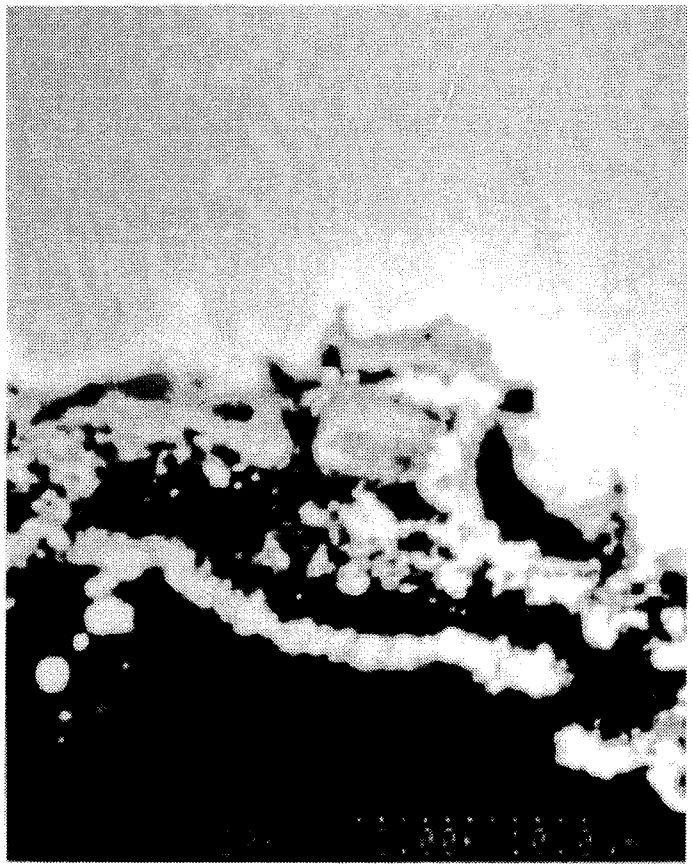

FIG. 16 is a photomicrograph (scale bar at right) of a surface of a 347 stainless steel sample which was heat treated in an electric furnace at 1650° F. in air for 1 hour. After two weeks at 1150° F. in a carburizing atmosphere, the stannide migrated under the eskolaite ($Cr_2O_3$) layer (dark).

Figure 17:
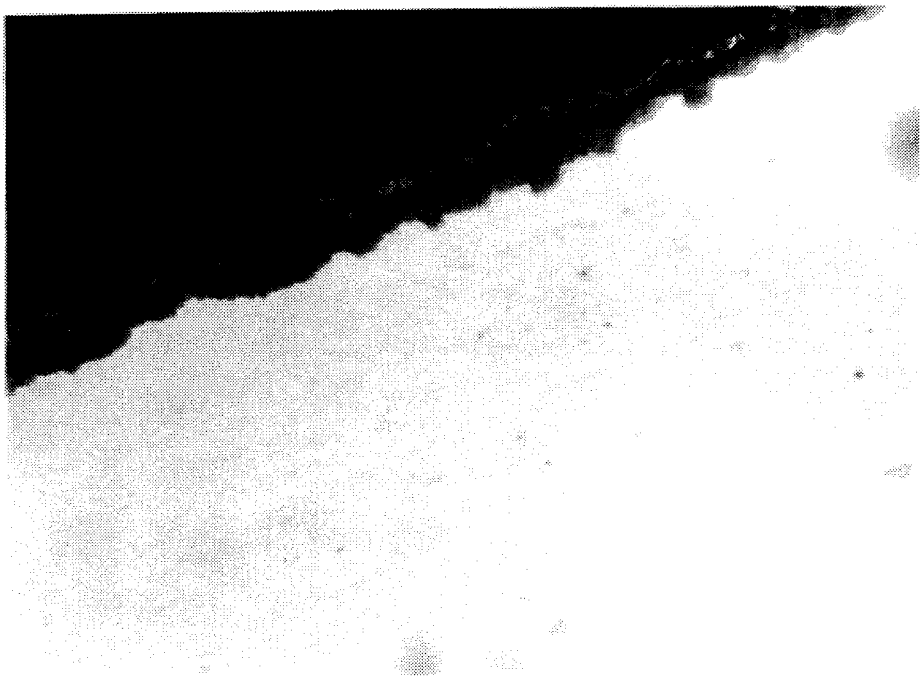

FIG. 17 is a photomicrograph (reflected light, 200×, 1 cm=50 μm) of a surface of a 347 stainless steel sample which was heat treated in a flame furnace at 1650° F. in air for 2½ hours. This treatment produced a much thicker oxide scale than the treatment in the electric furnace. The scale is approximately 40 μm thick.

Figure 18:
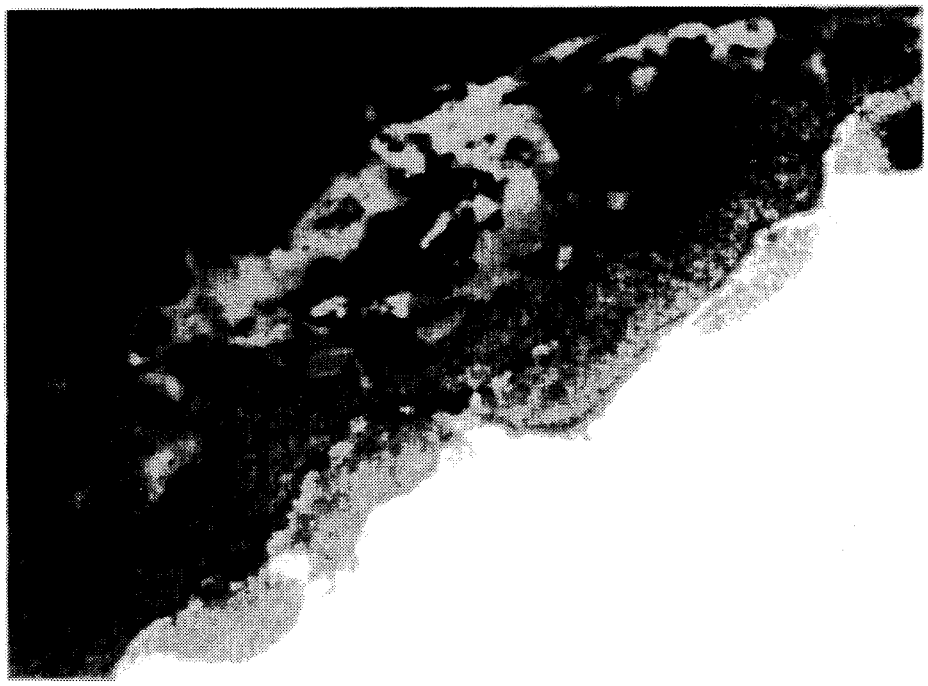

FIG. 18 is a photomicrograph (reflected light, 1250×, 1 cm=8 μm) of a surface of a 347 stainless steel sample which was heat treated in a flame furnace at 1650° F. in air for 2½ hours. The scale is more complex than the scale obtained by heat treatment in the electric furnace. The outermost layer (bright) is hematite ($Fe_2O_3$). Under the hematite layer is a layer of magnetite (darker). Under the magnetite layer is a layer of ferrochromite shot with a fine, nickel-rich metal dust. A thin layer (darkest) of pure ferrochromite coats the steel surface (very bright).

Figure 19:
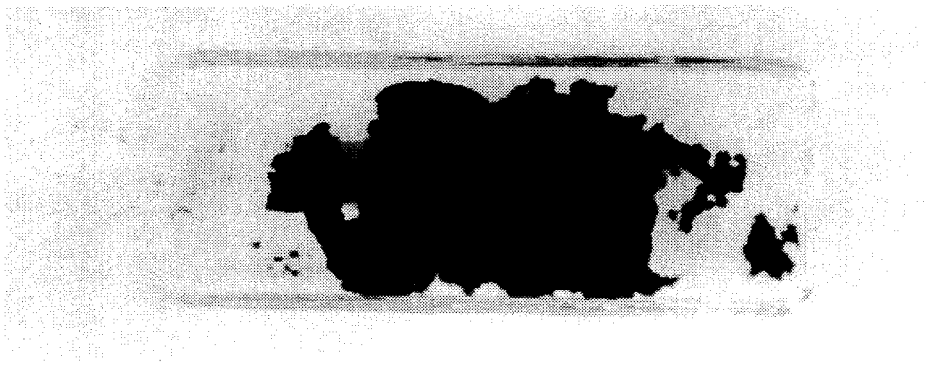

FIG. 19 is a photograph (approximately 2×) of a sample of a 347 stainless steel which was heat treated in a flame furnace at 1650° F. in air for 2½ hours. When exposed to a carburizing atmosphere for three hours at 1050° F., the sample coked profusely on the oxidized surfaces. Moreover, some coke also formed on the unoxidized surfaces.

Figure 20:
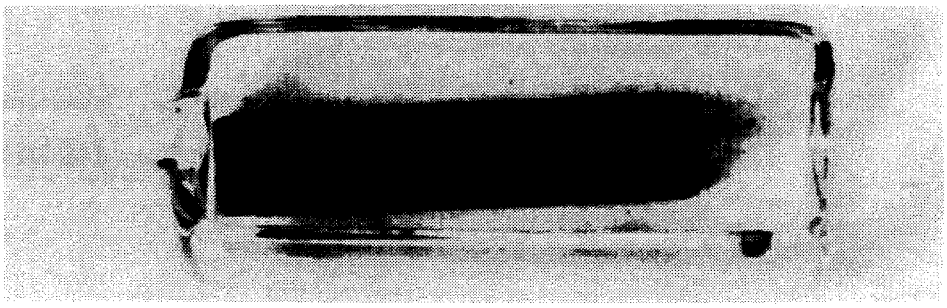

FIG. 20 is a photograph of a sample of 347 stainless steel which was heat treated in a flame furnace at 1650° F. in air for 2½ hours. The sample which had received a protective coating of tin paint was nearly coke free after five days at 1150° F.

Figure 21:
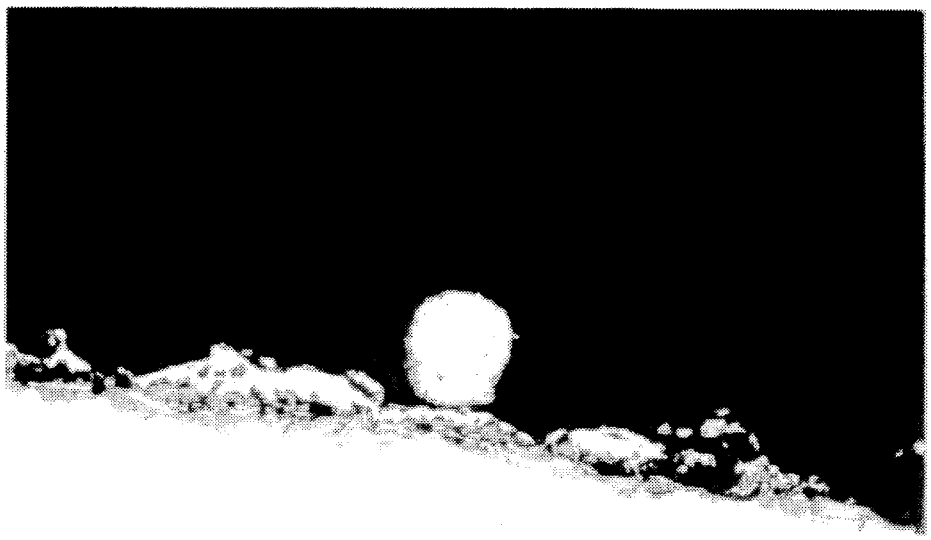

FIG. 21 is a photomicrograph (reflected light, 200×, 1 cm=50 μm) of a sample of 347 stainless steel which was heat treated in a flame furnace at 1650° F. in air for 2½ hours. After five days at 1150° F. in a carburizing atmosphere, a stannide layer (bright gray) formed atop a layer of oxide (darker) on the steel surface that had been painted with plain tin paint. The oxides are heavily veined with stannide. A ball of unreacted tin rests on the stannide surface.

Figure 22:
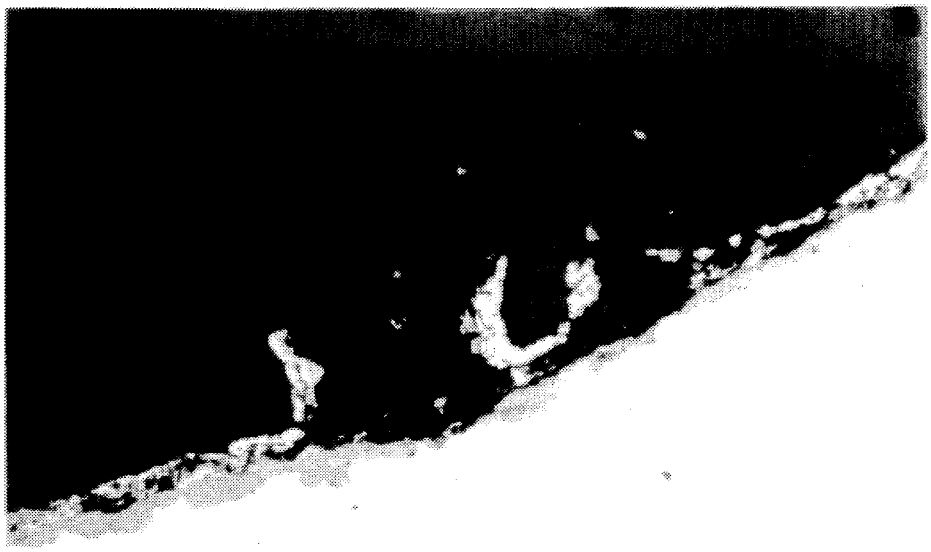

FIG. 22 is a photomicrograph (reflected light, 200×, 1 cm=50 μm) of a surface of a 347 stainless steel sample which was heat treated in a flame furnace at 1650° F. in air for 2½ hours. On the oxidized surface that had been painted with $Fe_2O_3$-modified tin paint, the exterior stannide layer was locally breached exposing the underlying oxide. This is the surface shown in FIG. 20.

Figure 23:
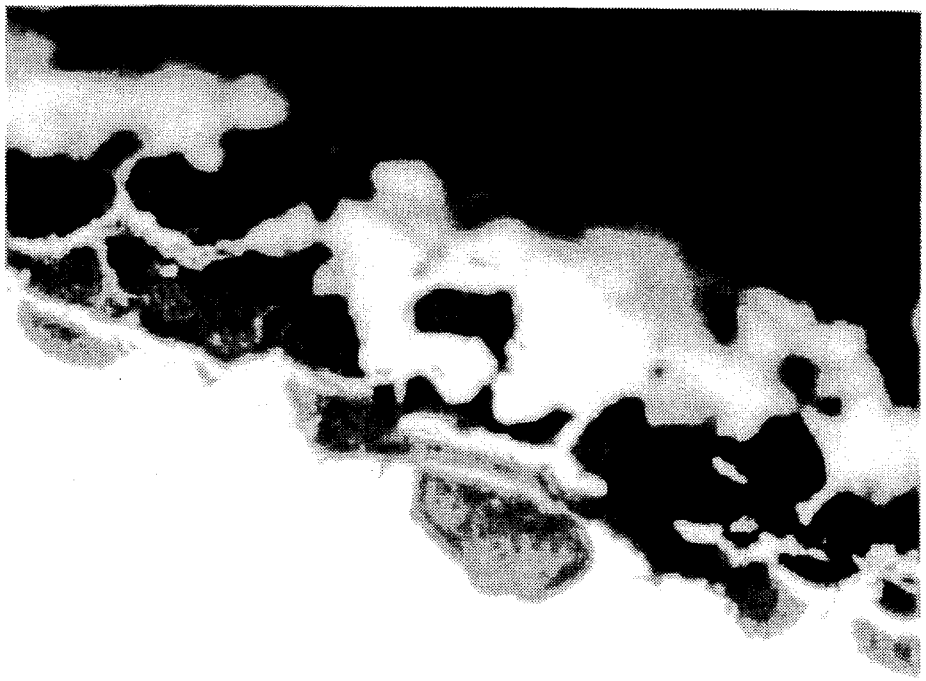

FIG. 23 is a photomicrograph (reflected light, 1250×, 1 cm=8 μm) of a surface of a 347 stainless steel sample which was heat treated in a flame furnace at 1650° F. in air for 2½ hours. On the surface treated with plain tin paint, a continuous layer of stannide (gray) was formed on the steel under the oxide.

Figure 24:
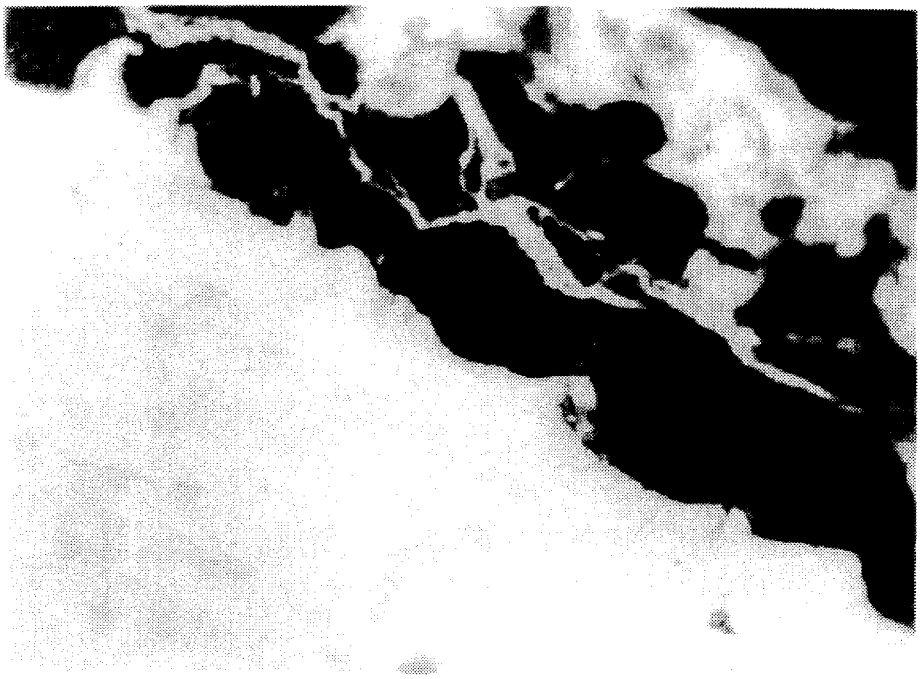

FIG. 24 is a photomicrograph (reflected light, 1250×, 1 cm=8 μm) of a surface of a 347 stainless steel sample which was heat treated in a flame furnace at 1650° F. in air for 2½ hours. The side painted with ferruginous paint exhibited a sparse and discontinuous stannide under the oxide.

Figure 25:
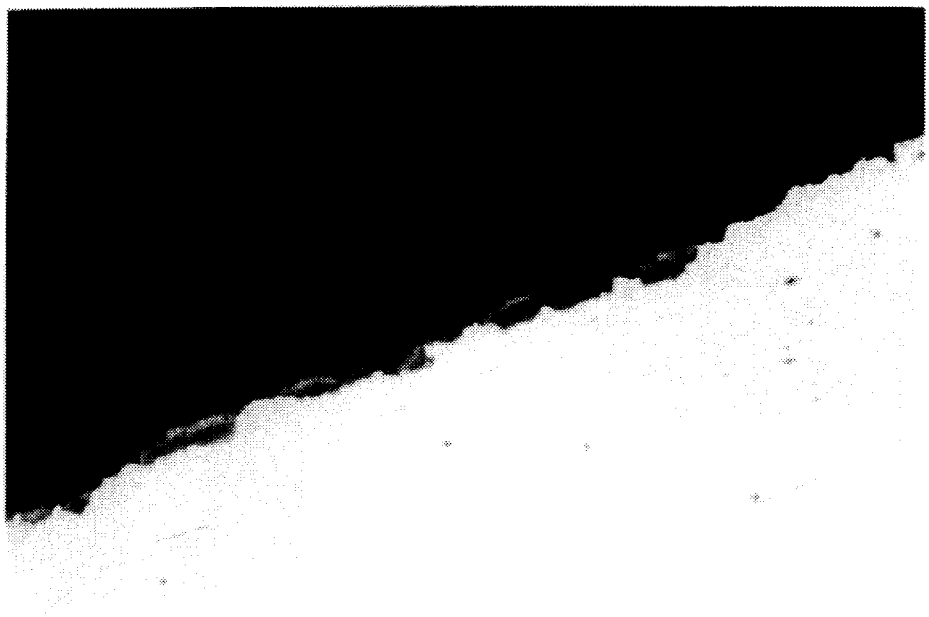

FIG. 25 is a photomicrograph (reflected light, 200×, 1 cm=50 μm) of a surface of a 347 stainless steel sample which was heat treated in an electric furnace at 1650° F. in air for 2½ hours. The exterior of the sample was exposed to air during the heat treatment. This produced a complex oxide scale similar to that produced in the flame furnace but thinner.

Figure 26:
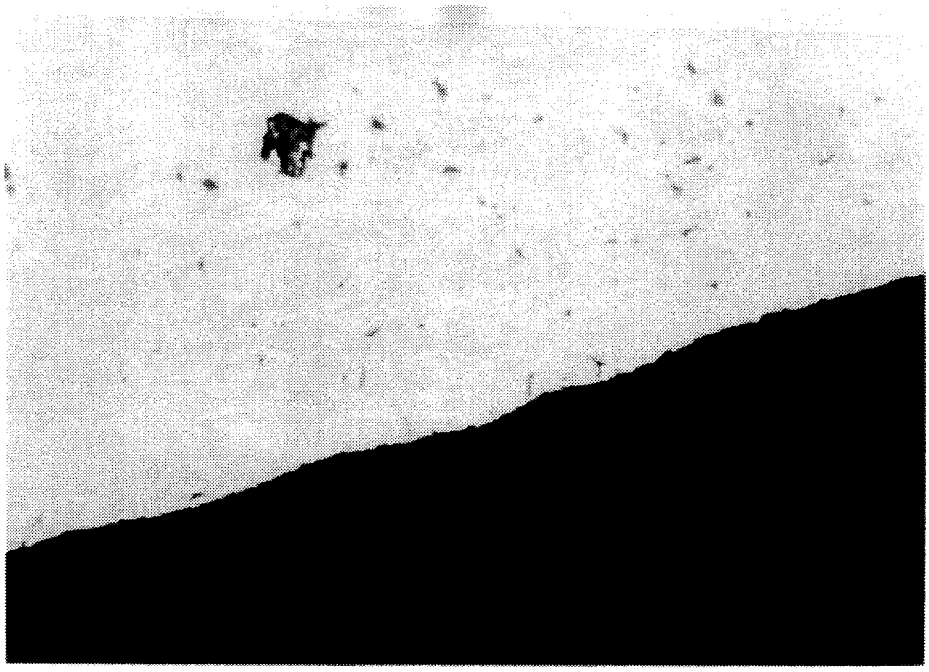

FIG. 26 is a photomicrograph (reflected light, 200×, 1 cm=50 μm) of a surface of a 347 stainless steel sample which was heat treated in an electric furnace at 1650° F. in $N_2$ for 2½ hours. Only a trace of oxide was formed.

Figure 27:
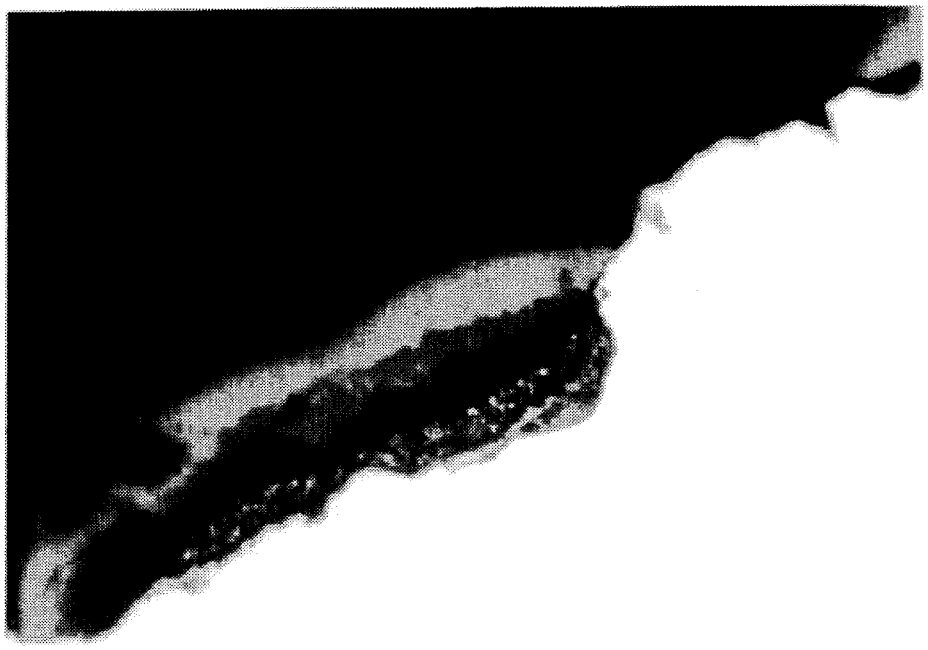

FIG. 27 is a photomicrograph (reflected light, 1250×, 1 cm=8 μm) of a surface of a 347 stainless steel sample heat treated in an electric furnace at 1650° F. in air for 2½ hours. An exterior layer of hematite (gray), underlain by magnetite (gray), underlain by ferrochromite (dark) shot with fine metal particles is shown.

Figure 28:
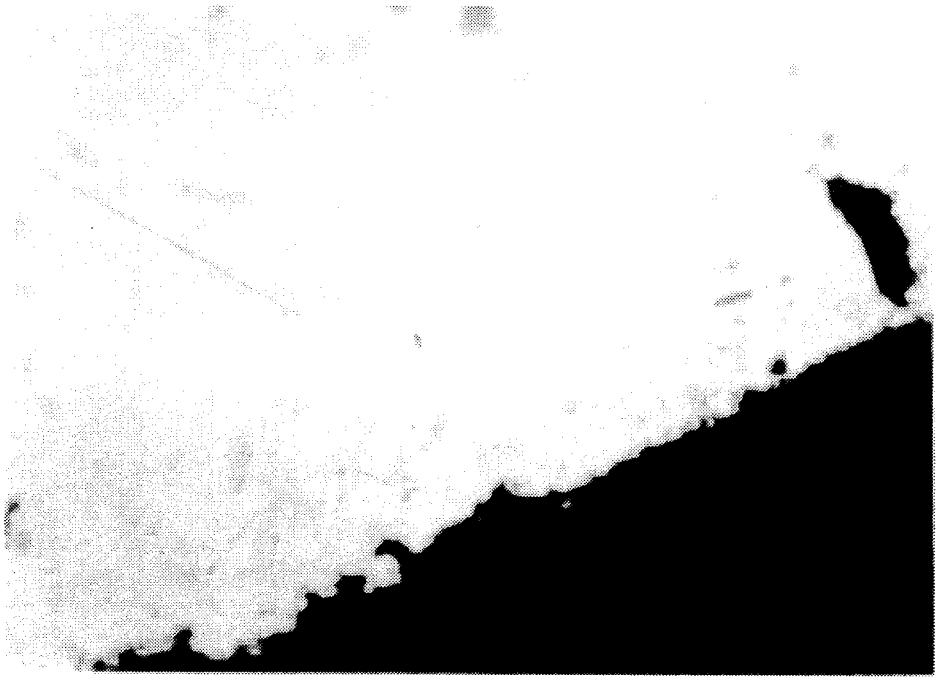

FIG. 28 is a photomicrograph (reflected light, 1250×, 1 cm=8 μm) of a surface of a 347 stainless steel sample heat treated in an electric furnace at 1650° F. in $N_2$ for 2½ hours.

On the nitrogen exposed side, scattered pockets filled with oxide and chloride (dark) and an edge zone with abundant grain boundary carbides or possibly nitrides is shown. The carbide enriched zone is about 15 μm thick.

Figure 29:
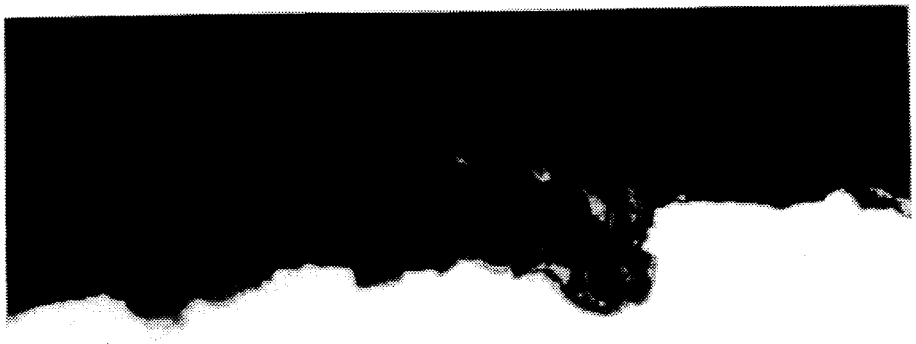

FIG. 29 is a photomicrograph (reflected light, 200×, 1 cm=50 μm) of a surface of a 347 stainless steel sample which was heat treated in an electric furnace at 1650° F. in air for 2½ hours. When this sample was exposed to the carburizing atmosphere at 900° F. for five days, the oxide surface erupted with coke.

Figure 30:
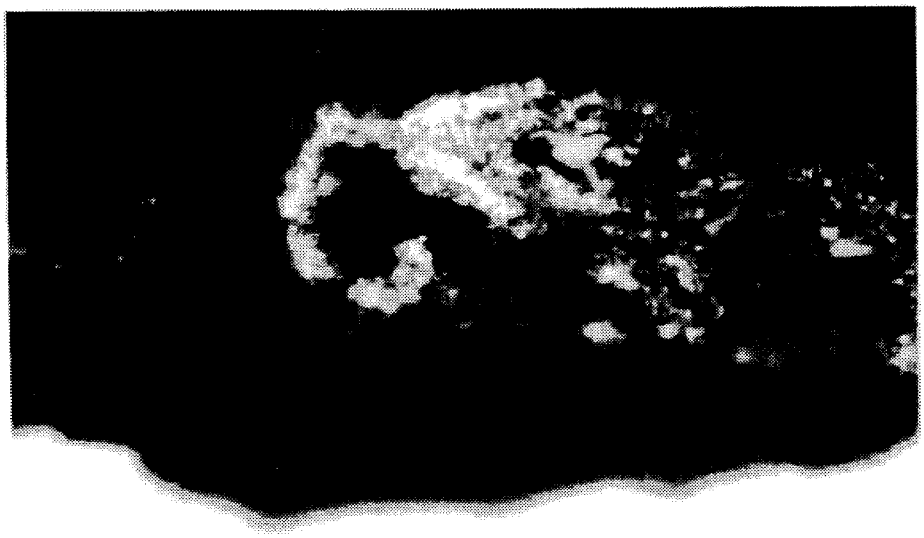

FIG. 30 is a photomicrograph (reflected light, 1250×, 1 cm=8 μm) of the surface of the 347 stainless steel sample shown in FIG. 29. The oxide was reduced to finely porous metal (bright white) and coke (dark) deposited on this metal. The steel surface (bright white) is at the bottom.

DETAILED DESCRIPTION OF THE PREFERRED EMBODIMENTS

The metallurgical terms used herein are to be given their common metallurgical meanings as set forth in THE METALS HANDBOOK of the American Society of Metals. For example, "carbon steels" are those steels having no specified minimum quantity for any alloying element (other than the commonly accepted amounts of manganese, silicon and copper) and containing only an incidental amount of any element other than carbon, silicon, manganese, copper, sulfur and phosphorus. "Mild steels" are those carbon steels with a maximum of about 0.25% carbon. Alloy steels are those steels containing specified quantities of alloying elements (other than carbon and the commonly accepted amounts of manganese, copper, silicon, sulfur and phosphorus) within the limits recognized for constructional alloy steels, added to effect changes in mechanical or physical properties. Alloy steels will contain less than 10% chromium. Stainless steels are any of several steels containing at least 10, preferably 12 to 30%, chromium as the principal alloying element.

One focus of the invention is to provide an improved method for reforming hydrocarbons using a reforming catalyst, particularly a large pore zeolite catalyst including an alkali or alkaline earth metal and charged with one or more Group VIII metals which is sulfur sensitive, under conditions of low sulfur. Such a process, of course, must demonstrate better resistance to carburization than conventional low-sulfur reforming techniques, yet contain little sulfur available to poison the catalyst.

One solution for the problem addressed by the present invention is to pretreat existing oxidized reactor systems to prevent the reduction of oxide scales to finely porous Fe, Ni metal and improve resistance to carburization and metal dusting during reforming using a reforming catalyst such as the aforementioned sulfur sensitive large-pore zeolite catalyst under conditions of low sulfur.

By "reactor system", as used herein, there is intended at least one reforming reactor and its corresponding furnace means and piping. This term also includes other reactors and their corresponding furnaces and piping wherein the carburization is a problem under low sulfur conditions or those systems wherein the aforementioned sulfur sensitive large-pore zeolite catalysts are utilized. Such systems include reactor systems used in processes for dehydrogenation and thermal dealkylation of hydrocarbons. Thus, by "reaction conditions" as used herein, there is intended, those conditions required to convert the feed hydrocarbons to a desired product.

The aforementioned problems with low-sulfur reforming can be effectively addressed by a selection of an appropriate reactor system material for contact with the hydrocarbons during processing. Typically, reforming reactor systems have been constructed of mild steels, or alloy steels such as typical chromium steels, with insignificant carburization and dusting. For example, under conditions of standard reforming, 2¼ Cr furnace tubes can last twenty years. However, it was found that these steels are unsuitable under low-sulfur reforming conditions. They rapidly become embrittled by carburization within about one year. For example, it was found that 2½ Cr 1 Mo steel carburized and embrittled more than 1 mm/year.

Furthermore, it was found that materials considered under standard metallurgical practice to be resistant to coking and carburization are not necessarily resistant under low-sulfur reforming conditions. For example, nickel-rich alloys such as Incoloy 800 and 825; Inconel 600; Marcel and Haynes 230, are unacceptable as they exhibit excessive coking and dusting.

However, 300 series stainless steels, preferably 304, 316, 321 and 347, are acceptable as materials for at least portions of the reactor system according to the present invention which contact the hydrocarbons. They have been found to have a resistance to carburization greater than mild steels and nickel-rich alloys.

In some areas of the reactor systems, localized temperatures can become excessively high during reforming (e.g., 900°–1250° F.). This is particularly the case in furnace tubes, and in catalyst beds where exothermic demethanation reactions occur within normally occurring coke balls causing localized hot regions. While still preferred to mild steels and nickel-rich alloys, the 300 series stainless steels do exhibit some coking and dusting at around 1000° F. Thus, while useful, the 300 series stainless steels are not the most preferred material for use in the present invention.

Chromium-rich stainless steels such as 446 and 430 are even more resistant to carburization than 300 series stainless steels. However, these steels are not as desirable for heat resisting properties (they tend to become brittle).

Resistant materials which are preferred over the 300 series stainless steels for use in the present invention include copper, tin, arsenic, antimony, bismuth, chromium, germanium, indium, selenium, tellurium and brass, and intermetallic compounds and alloys thereof (e.g., Cu—Sn alloys, Cu—Sb alloys, stannides, antimonides, bismuthides, etc.). Steels and even nickel-rich alloys containing these metals can also show reduced carburization.

Reactor systems previously exposed to an oxidative atmosphere are not preferred when such systems utilize the aforementioned sulfur sensitive large-pore zeolite catalyst systems. For example, heating such reactor systems in air to remove stress may promote the formation of oxide scales. When these oxide scales reduce, they may form finely porous Fe, Ni metal, which is extremely reactive for coking and can infect underlying steel with carburization and pitting.

These previously oxidized steels may, according to the present invention, be treated with carburization resistant materials to prevent the formation of the finely porous Fe, Ni metal, which significantly reduces coking, carburization and metal dusting under reaction conditions. Such materials may also allow for the removal of oxygen from reactor walls with the possible release of water and/or the fixation of the oxides by forming a continuous protective coating over the oxide.

In a preferred embodiment, these materials are provided as a plating, cladding, paint (e.g., oxide paints) or other coating to a base construction material. This is particularly advantageous since conventional construction materials such as mild steels can still be used with only the surface contacting the hydrocarbons being treated. Of these, tin is especially preferred as it reacts with the surface to provide a coating having excellent carburization resistance at higher temperatures, and which resists peeling and flaking of the coating. Also, it is believed that a tin containing layer can be as thin as 1/10 micron and still prevent carburization.

In addition, it has been observed that with the use of such reactor systems, tin attacks the sulfided metal surfaces including FeS replacing sulfur and releasing $H_2S$. Thus, application of resistant materials such as tin to a reactor system to prevent coking, carburization and metal dusting can also protect sulfur sensitive catalysts when applied to previously sulfided reactor systems.

Where practical, it is preferred that the resistant materials be applied in a paint-like formulation (hereinafter "paint") to a new or existing reactor system. Such a paint can be sprayed, brushed, pigged, etc. on reactor system surfaces such as mild steels or stainless steels. It is most preferred that such a paint be a decomposable, reactive, tin-containing paint which reduces to a reactive tin and forms metallic stannides (e.g., iron stannides and nickel/iron stannides) upon heating in a reducing atmosphere.

It is most preferred that the aforementioned paint contain at least four components (or their functional equivalents); (i) a hydrogen decomposable tin compound, (ii) a solvent system, (iii) a finely divided tin metal and (iv) tin oxide as a reducible sponge/dispersing/binding agent. The paint should contain finely divided solids to minimize settling, and should not contain non-reactive materials which will prevent reaction of reactive tin with surfaces of the reactor system.

As the hydrogen decomposable tin compound, tin octanoate or neodecanoate is particularly useful. Commercial formulations of this compound itself are available and will partially dry to an almost chewing-gum-like layer on a steel surface; a layer which will not crack and/or split. This property is necessary for any coating composition used in this context because it is conceivable that the coated material will be stored for months prior to treatment with hydrogen. Also, if parts are coated prior to assembly they must be resistant to chipping during construction. As noted above, tin octanoate is available commercially. It is reasonably priced, and will decompose smoothly to a reactive tin layer which forms iron stannide in hydrogen at temperatures as low as 600° F.

Tin octanoate should not be used alone in a paint, however. It is not sufficiently viscous. Even when the solvent is evaporated therefrom, the remaining liquid will drip and run on the coated surface. In practice, for example, if such were used to coat a horizontal furnace tube, it would pool at the bottom of the tube.

Component (iv), the tin oxide sponge/dispersing/binding agent, is a porous tin-containing compound which can sponge-up an organo-metallic tin compound, yet still be reduced to active tin in the reducing atmosphere. In addition, tin oxide can be processed through a colloid mill to produce very fine particles which resist rapid settling. The addition of tin oxide will provide a paint which becomes dry to the touch, and resists running.

Unlike typical paint thickeners, component (iv) is selected such that it becomes a reactive part of the coating when reduced. It is not inert like formed silica; a typical paint thickener which would leave an unreactive surface coating after treatment.

Finely divided tin metal, component (iii), is added to insure that metallic tin is available to react with the surface to be coated at as low a temperature as possible, even in a non-reducing atmosphere. The particle size of the tin is preferably one to five microns which allows excellent coverage of the surface to be coated with tin metal. Non-reducing conditions can occur during drying of the paint and welding of pipe joints. The presence of metallic tin ensures that even when part of the coating is not completely reduced, tin metal will be present to react and form the desired stannide layer.

The solvent should be non-toxic, and effective for rendering the paint sprayable and spreadable when desired. It should also evaporate quickly and have compatible solvent properties for the hydrogen decomposable tin compound. Isopropyl alcohol is most preferred, while hexane and pentane can be useful, if necessary. Acetone, however, tends to precipitate organic tin compounds.

In one embodiment, there can be used a tin paint of 20 percent Tin Ten-Cem (stannous octanoate in octanoic acid or neodecanoate in neodecanoic acid), stannic oxide, tin metal powder and isopropyl alcohol.

The tin paint can be applied in many ways. For example, furnace tubes of the reactor system can be painted individually or as modules. A reforming reactor system according to the present invention can contain various numbers of furnace tube modules (e.g., about 24 furnace tube modules) of suitable width, length and height (e.g., about 10 feet long, about 4 feet wide, and about 40 feet in height). Typically, each module will include two headers of suitable diameter, preferably about 2 feet in diameter, which are connected by about four to ten u-tubes of suitable length (e.g., about 42 feet long). Therefore, the total surface area to be painted in the modules can vary widely; for example, in one embodiment it can be about 16,500 $ft^2$.

Painting modules rather than the tubes individually can be advantageous in at least four respects; (i) painting modules rather than individual tubes should avoid heat destruction of the tin paint as the components of the modules are usually heat treated at extremely elevated temperatures during production; (ii) painting modules will likely be quicker and less expensive than painting tubes individually; (iii) painting modules should be more efficient during production scheduling; and (iv) painting of the modules should enable painting of welds.

However, painting the modules may not enable the tubes to be as completely coated with paint as if the tubes were painted individually. If coating is insufficient, the tubes can be coated individually.

It is preferable that the paint be sprayed into the tubes and headers. Sufficient paint should be applied to fully coat the tubes and headers. After a module is sprayed, it should be left to dry for about 24 hours followed by application of a slow stream of heated nitrogen (e.g., about 150° F. for about 24 hours). Thereafter, it is preferable that a second coat of paint be applied and also dried by the procedure described above. After the paint has been applied, the modules should preferably be kept under a slight nitrogen pressure and should not be exposed to temperatures exceeding about 200° F. prior to installation, nor should they be exposed to water except during hydrotesting.

Iron bearing reactive paints are also useful in the present invention. Such an iron bearing reactive paint will preferably contain various tin compounds to which iron has been added in amounts up to one third Fe/Sn by weight.

The addition of iron can, for example, be in the form of $Fe_2O_3$. The addition of iron to a tin containing paint should afford noteworthy advantages; in particular: (i) it should facilitate the reaction of the paint to form iron stannides thereby acting as a flux; (ii) it should dilute the nickel concentration in the stannide layer thereby providing better protection against coking; and (iii) it should result in a paint which affords the anti-coking protection of iron stannides even if the underlying surface does not react well.

Yet another means for preventing carburization, coking, and metal dusting in the low-sulfur reactor system comprises the application of a metal coating or cladding to chromium rich steels contained in the reactor system. These metal coatings or claddings may be comprised of tin, antimony, bismuth, germanium, indium, selenium, tellurium or arsenic. Tin is especially preferred. These coatings or claddings may be applied by methods including electroplating, vapor depositing, and soaking of the chromium rich steel in a molten metal bath.

It has been found that in reactor systems where carburization, coking, and metal dusting are particularly problematic that the coating of the chromium-rich, nickel-containing steels with a layer of tin in effect creates a double protective layer. There results an inner chromium rich layer which is resistant to carburization, coking, and metal dusting and an outer tin layer which is also resistant to carburization, coking and metal dusting. This occurs because when the tin coated chromium rich steel is exposed to typical reforming temperatures, such as about 1200° F., it reacts with the steel to form nickel-rich iron nickel stannides. Thereby, the nickel is preferentially leached from the surface of the steel leaving behind a layer of chromium rich steel. In some instances, it may be desirable to remove the iron nickel stannide layer from the stainless steel to expose the chromium rich steel layer.

For example, it was found that when a tin cladding was applied to a 304 grade stainless steel and heated at about 1200° F. there resulted a chromium rich steel layer containing about 17% chromium and substantially no nickel, comparable to 430 grade stainless steel.

When applying the tin metal coating or cladding to the chromium rich steel, it may be desirable to vary the thickness of the metal coating or cladding to achieve the desired resistance against carburization, coking, and metal dusting. This can be done by, e.g., adjusting the amount of time the chromium rich steel is soaked in a molten tin bath. This will also affect the thickness of the resulting chromium rich steel layer. It may also be desirable to vary the operating temperature, or to vary the composition of the chromium rich steel which is coated which in order to control the chromium concentration in the chromium rich steel layer produced.

It has additionally been found that tin-coated steels can be further protected from carburization, metal dusting, and coking by a post-treatment process which involves application of a thin oxide coating, preferably a chromium oxide, such as $Cr_2O_3$. This coating will be thin, as thin as a few μm. Application of such a chromium oxide will protect aluminum as well as tin coated steels, such as Alonized steels, under low-sulfur reforming conditions.

The chromium oxide layer can be applied by various methods including: application of a chromate or dichromate paint followed by a reduction process; vapor treatment with an organo-chromium compound; or application of a chromium metal plating followed by oxidation of the resulting chromium plated steel.

Examination of tin-electroplated steels which have been subjected to low-sulfur reforming conditions for a substantial period of time has shown that when a chromium oxide layer is produced on the surface of the stannide layer or under the stannide layer, the chromium oxide layer does not cause deterioration of the stannide layer, but appears to render the steel further resistant to carburization, coking and metal dusting. Accordingly, application of a chromium oxide layer to either tin or aluminum coated steels will result in steels which are further resistant to carburization and coking under the low-sulfur reforming conditions. This post-treatment process has particular applications for treating tin or aluminum coated steels which, after prolonged exposure to low-sulfur reforming conditions, are in need of repair.

While not wishing to be bound by theory, it is believed that the suitability of various materials for the present invention can be selected and classified according to their responses to carburizing atmospheres. For example, iron, cobalt, and nickel form relatively unstable carbides which will subsequently carburize, coke and dust. Elements such as chromium, niobium, vanadium, tungsten, molybdenum, tantalum and zirconium, will form stable carbides which are more resistant to carburization coking and dusting. Elements such as tin, antimony and bismuth do not form carbides or coke. And, these compounds can form stable compounds with many metals such as iron, nickel and copper under reforming conditions. Stannides, antimonides and bismuthides, and compounds of lead, mercury, arsenic, germanium, indium, tellurium, selenium, thallium, sulfur and oxygen are also resistant. A final category of materials include elements such as silver, copper, gold, platinum and refractory oxides such as silica and alumina. These materials are resistant and do not form carbides, or react with other metals in a carburizing environment under reforming conditions.

Because different areas of the reactor system of the invention (e.g., different areas in a furnace) can be exposed to a wide range of temperatures, the material selection and thickness of coating can be staged, such that better carburization resistances are used in those areas of the system experiencing the highest temperatures. In any case, the carburization resistant coating should be used in amounts such that the metal oxides present in the reactor system do not consume the entire protective coating. It is preferred that any remaining oxide in the oxidated surfaces is fixated. By "fixated" as used herein, it is meant applying a coating of the carburization resistant coating over the oxidized metal such that the oxide does not form finely porous Fe, Ni metal and the like, which is extremely reactive for coking and may infect underlying steel with carburization and pitting.

With regard to materials selection, it was discovered that oxidized Group VIII metal surfaces such as iron, nickel and cobalt are more active in terms of coking and carburization than their unoxidized counterparts. For example, it was found that an air roasted sample of 347 stainless steel was significantly more active than an unoxidized sample of the same steel. This is believed to be due to a re-reduction of oxidized steels which produces very fine-grained iron and/or nickel metals. Such metals are especially active for carburization and coking. Thus, it is desirable to avoid these materials as much as possible during oxidative regeneration processes, such as those typically used in catalytic reforming. However, it has been found that an air roasted 300 series stainless steel coated with tin can provide similar resistances to coking and carburization as unroasted samples of the same tin coated 300 series stainless steel.

Furthermore, it will be appreciated that oxidation will be a problem in systems where sulfur sensitivity of the catalyst is not of concern, and sulfur is used to passivate the metal surfaces. If sulfur levels in such systems ever become insufficient, any metal sulfides which have formed on metal surfaces would, after oxidation and reduction, be reduced to fine-grained metal. This metal would be highly reactive for coking and carburization. Potentially, this can cause a catastrophic failure of the metallurgy, or a major coking event.

As noted above, excessively high temperatures can occur in the catalyst beds when exothermic demethanation reactions within cokeballs cause localized hot regions. These hot spots also pose a problem in conventional reforming reactor systems (as well as other areas of chemical and petrochemical processing).

For example, the center pipe screens of reformers have been observed to locally waste away and develop holes; ultimately resulting in catalyst migration. In conventional reforming processes the temperatures within cokeballs during formation and burning are apparently high enough to overcome the ability of process sulfur to poison coking, carburization, and dusting. The metal screens, therefore, carburize and are more sensitive to wasting by intergranular oxidation (a type of corrosion) during regeneration. The screen openings enlarge and holes develop.

Thus, the teachings of the present invention are applicable to conventional reforming, as well as other areas of chemical and petrochemical processing. For example, the aforementioned platings, claddings and coatings can be used in the preparation of center pipe screens to avoid excessive hole development and catalyst migration. In addition, the teachings can be applied to any furnace tubes which are subjected to carburization, coking and metal dusting, such as furnace tubes in coker furnaces.

In addition, since the techniques described herein can be used to control carburization, coking, and metal dusting at excessively high temperatures, they can be used in cracking furnaces operating at from about 1400° to about 1700° F. For example, the deterioration of steel occurring in cracking furnaces operating at those temperatures can be controlled by application of various metal coatings. These metal coatings can be applied by melting, electroplating, and painting. Painting is particularly preferred.

For example, a coating of antimony applied to iron bearing steels protects these steels from carburization, coking and metal dusting under the described cracking conditions. In fact, an antimony paint applied to iron bearing steels will provide protection against carburization, coking, and metal dusting at 1600° F.

A coating of bismuth applied to nickel rich steel alloys (e.g., INCONEL 600) can protect those steels against carburization, coking, and metal dusting under cracking conditions. This has been demonstrated at temperatures of up to 1600° F.

Bismuth coatings may also be applied to iron bearing steels and provide protection against carburization, metal dusting, and coking under cracking conditions. Also, a metal coating comprising a combination of bismuth, antimony, and/or tin can be used.

Looking again to low-sulfur reforming, other techniques can also be used to address the problem discovered according to the present invention. They can be used in conjunction with an appropriate material selection for the reactor system, or they can be used alone. Preferred from among the additional techniques is the addition of non-sulfur, anti-carburizing and anti-coking agent(s) during the reforming process. These agents can be added continuously during processing and function to interact with those surfaces of the reactor system which contact the hydrocarbons, or they may be applied as a pretreatment to the reactor system.

While not wishing to bound by theory it is believed that these agents interact with the surfaces of the reactor system by decomposition and surface attack to form iron and/or nickel intermetallic compounds, such as stannides, antimonides, bismuthides, plumbides, arsenides, etc. Such intermetallic compounds are resistant to carburization, coking and dusting and can protect the underlying metallurgy.

The intermetallic compounds are also believed to be more stable than the metal sulfides which were formed in systems where $H_2S$ was used to passivate the metal. These compounds are not reduced by hydrogen as are metal sulfides. As a result, they are less likely to leave the system than metal sulfides. Therefore, the continuous addition of a carburization inhibitor with the feed can be minimized.

Preferred non-sulfur anti-carburizing and anti-coking agents include organo-metallic compounds such as organo-tin compounds, organo-antimony compounds, organo-bismuth compounds, organo-arsenic compounds, and organo-lead compounds. Suitable organo-lead compounds include tetraethyl and tetramethyl lead. Organo-tin compounds such as tetrabutyl tin and trimethyl tin hydride are especially preferred.

Additional specific organo-metallic compounds include bismuth neodecanoate, chromium octoate, copper naphthenate, manganese carboxylate, palladium neodecanoate, silver neodecanoate, tetrabutylgermanium, tributylantimony, triphenylantimony, triphenylarsine, and zirconium octoate.

How and where these agents are added to the reactor system is not critical, and will primarily depend on particular process design characteristics. For example, they can be added continuously or discontinuously with the feed.

However, adding the agents to the feed is not preferred as they would tend to accumulate in the initial portions of the reactor system. This may not provide adequate protection in the other areas of the system.

It is preferred that the agents be provided as a coating prior to construction, prior to start-up, or in-situ (i.e., in an existing system). If added in-situ, it should be done right after catalyst regeneration. Very thin coatings can be applied. For example, it is believed that when using organo-tin compounds, iron stannide coatings as thin as 0.1 micron can be effective.

A preferred method of coating the agents on an existing or new reactor surface, or a new or existing furnace tube is to decompose an organometallic compound in a hydrogen atmosphere at temperatures of about 900° F. For organo-tin compounds, for example, this produces reactive metallic tin on the tube surface. At these temperatures the tin will further react with the surface metal to passivate it.

Optimum coating temperatures will depend on the particular organometallic compound, or the mixtures of compounds if alloys are desired. Typically, an excess of the organometallic coating agent can be pulsed into the tubes at a high hydrogen flow rate so as to carry the coating agent throughout the system in a mist. The flow rate can then be reduced to permit the coating metal mist to coat and react with the furnace tube or reactor surface. Alternatively, the compound can be introduced as a vapor which decomposes and reacts with the hot walls of the tube or reactor in a reducing atmosphere.

As discussed above, reforming reactor systems susceptible to carburization, metal dusting and coking can be treated by application of a decomposable coating containing a decomposable organometallic tin compound to those areas of the reactor system most susceptible to carburization. Such an approach works particularly well in a temperature controlled furnace.

However, such control is not always present. There are "hot spots" which develop in the reactor system, particularly in the furnace tubes, where the organometallic compound can decompose and form deposits. Therefore, another aspect of the invention is a process which avoids such deposition in reforming reactor systems where temperatures are not closely controlled and exhibit areas of high temperature hot spots.

Such a process involves preheating the entire reactor system to a temperature of from 750° to 1150° F., preferably 900° to 1100° F., and most preferably about 1050° F., with a hot stream of hydrogen gas. After preheating, a colder gas stream at a temperature of 400° to 800° F., preferably 500° to 700° F., and most preferably about 550° F., containing a vaporized organometallic tin compound and hydrogen gas is introduced into the preheated reactor system. This gas mixture is introduced upstream and can provide a decomposition "wave" which travels throughout the entire reactor system.

Essentially this process works because the hot hydrogen gas produces a uniformly heated surface which will decompose the colder organometallic gas as it travels as a wave throughout the reactor system. The colder gas containing the organometallic tin compound will decompose on the hot surface and coat the surface. The organometallic tin vapor will continue to move as a wave to treat the hotter surfaces downstream in the reactor system. Thereby, the entire reactor system can have a uniform coating of the organometallic tin compound. It may also be desirable to conduct several of these hot-cold temperature cycles to ensure that the entire reactor system has been uniformly coated with the organometallic tin compound.

In operation of the reforming reactor system according to the present invention, naphtha will be reformed to form aromatics. The naphtha feed is a light hydrocarbon, preferably boiling in the range of about 70° F. to 450° F., more preferably about 100° to 350° F. The naphtha feed will contain aliphatic or paraffinic hydrocarbons. These aliphatics are converted, at least in part, to aromatics in the reforming reaction zone.

In the "low-sulfur" system of the invention, the feed will preferably contain less than 100 ppm sulfur and more preferably, less than 50 ppm sulfur. When using a large pore zeolite catalyst, the feed will preferably contain less than 100 ppb sulfur, more preferably, less than 50 ppb sulfur, more preferably, less than 10 ppb sulfur, and even more preferably, less than 5 ppb sulfur. If necessary, a sulfur sorber unit can be employed to remove small excesses of sulfur.

Preferred reforming process conditions include a temperature between 700° and 1050° F., more preferably between 850° and 1025° F.; and a pressure between 0 and 400 psig, more preferably between 15 and 150 psig; a recycle hydrogen rate sufficient to yield a hydrogen to hydrocarbon mole ratio for the feed to the reforming reaction zone between 0.1 and 20, more preferably between 0.5 and 10; and a liquid hourly space velocity for the hydrocarbon feed over the reforming catalyst of between 0.1 and 10, more preferably between 0.5 and 5. At these temperatures, tin reacts with the oxidized metals to replace oxygen in the metals with tin.

To achieve the suitable reformer temperatures, it is often necessary to heat the furnace tubes to high temperatures. These temperatures can often range from 600° to 1800° F., usually from 850° and 1250° F., and more often from 900° and 1200° F.

As noted above, the problems of carburization, coking and metal dusting in low-sulfur systems have been found to associated with excessively high, localized process temperatures of the reactor system, and are particularly acute in the furnace tubes of the system where particularly high temperatures are characteristic. In conventional reforming techniques where high levels of sulfur are present, furnace tube skin temperatures of up to 1175° F. at end of run are typical. Yet, excessive carburization, coking and metal dusting was not observed. In low-sulfur systems, however, it has been discovered that excessive and rapid carburization, coking and metal dusting occurred with CrMo steels at temperatures above 950° F., and stainless steels at temperatures above 1025° F.

Accordingly, another aspect of the invention is to lower the temperatures of the metal surfaces inside the furnace tubes, transfer-lines and/or reactors of the reforming system below the aforementioned levels. For example, temperatures can be monitored using thermocouples attached at various locations in the reactor system. In the case of furnace tubes, thermocouples can be attached to the outer walls thereof, preferably at the hottest point of the furnace (usually near the furnace outlet). When necessary, adjustments in process operation can be made to maintain the temperatures at desired levels.

There are other techniques for reducing exposure of system surfaces to undesirably high temperatures as well. For example, heat transfer areas can be used with resistant (and usually more costly) tubing in the final stage where temperatures are usually the highest.

In addition, superheated hydrogen can be added between reactors of the reforming system. Also, a larger catalyst charge can be used. And, the catalyst can be regenerated more frequently. In the case of catalyst regeneration, it is best accomplished using a moving bed process where the catalyst is withdrawn from the final bed, regenerated, and charged to the first bed.

Carburization and metal dusting can also be minimized in the low-sulfur reforming reactor system of the invention by using certain other novel equipment configurations and process conditions. For example, the reactor system can be constructed with staged heaters and/or tubes. In other words, the heaters or tubes which are subjected to the most extreme temperature conditions in the reactor system can be constructed of materials more resistant to carburization than materials conventionally used in the construction of reforming reactor systems; materials such as those described above. Heaters or tubes which are not subjected to extreme temperatures can continue to be constructed of conventional materials.

By using such a staged design in the reactor system, it is possible to reduce the overall cost of the system (since carburization resistant materials are generally more expensive than conventional materials) while still providing a reactor system which is sufficiently resistant to carburization and metal dusting under low-sulfur reforming conditions. Additionally, this should facilitate the retrofitting of existing reforming reactor systems to render them carburization and metal dusting resistant under low-sulfur operating conditions; since a smaller portion of the reactor system would need replacement or modification with a staged design.

The reactor system can also be operated using at least two temperature zones; at least one of higher and one of lower temperature. This approach is based on the observation that metal dusting has a temperature maximum and minimum, above and below which dusting is minimized. Therefore, by "higher" temperatures, it is meant that the temperatures are higher than those conventionally used in reforming reactor systems and higher than the temperature maximum for dusting. By "lower" temperatures it is meant that the temperature is at or about the temperatures which reforming processes are conventionally conducted, and falls below that in which dusting becomes a problem.

Operation of portions of the reactor system in different temperature zones should reduce metal dusting as less of the reactor system is at a temperature conducive for metal dusting. Also, other advantages of such a design include improved heat transfer efficiencies and the ability to reduce equipment size because of the operation of portions of the system at higher temperatures. However, operating portions of the reactor system at levels below and above that conducive for metal dusting would only minimize, not completely avoid, the temperature range at which metal dusting occurs. This is unavoidable because of temperature fluctuations which will occur during day to day operation of the reforming reactor system; particularly fluctuations during shut-down and start-up of the system, temperature fluctuations during cycling, and temperature fluctuations which will occur as the process fluids are heated in the reactor system.

Another approach to minimizing metal dusting relates to providing heat to the system using superheated raw materials (such as e.g., hydrogen), thereby minimizing the need to heat the hydrocarbons through furnace walls.

Yet another process design approach involves providing a pre-existing reforming reactor system with larger tube diameters and/or higher tube velocities. Using larger tube diameters and/or higher tube velocities will minimize the exposure of the heating surfaces in the reactor system to the hydrocarbons.

As noted above, catalytic reforming is well known in the petroleum industry and involves the treatment of naphtha fractions to improve octane rating by the production of aromatics. The more important hydrocarbon reactions which occur during the reforming operation include the dehydrogenation of cyclohexanes to aromatics, dehydroisomerization of alkycyclopentanes to aromatics, and dehydrocyclization of acyclic hydrocarbons to aromatics. In addition, a number of other reactions also occur, including the dealkylation of alkylbenzenes, isomerization of paraffins, and hydrocracking reactions which produce light gaseous hydrocarbons, e.g., methane, ethane, propane and butane, which hydrocracking reactions should be minimized during reforming as they decrease the yield of gasoline boiling products and hydrogen. Thus, "reforming" as used herein refers to the treatment of a hydrocarbon feed through the use of one or more aromatics producing reactions in order to provide an aromatics enriched product (i.e., a product whose aromatics content is greater than in the feed).

While the present invention is directed primarily to catalytic reforming, it will be useful generally in the production of aromatic hydrocarbons from various hydrocarbon feedstocks under conditions of low sulfur. That is, while catalytic reforming typically refers to the conversion of naphthas, other feedstocks can be treated as well to provide an aromatics enriched product. Therefore, while the conversion of naphthas is a preferred embodiment, the present invention can be useful for the conversion or aromatization of a variety of feedstocks such as paraffin hydrocarbons, olefin hydrocarbons, acetylene hydrocarbons, cyclic paraffin hydrocarbons, cyclic olefin hydrocarbons, and mixtures thereof, and particularly saturated hydrocarbons.

Examples of paraffin hydrocarbons are those having 6 to 10 carbons such as n-hexane, methylpentane, n-haptane, methylhexane, dimethylpentane and n-octane. Examples of acetylene hydrocarbons are those having 6 to 10 carbon atoms such as hexyne, heptyne and octyne. Examples of acyclic paraffin hydrocarbons are those having 6 to 10 carbon atoms such as methylcyclopentane, cyclohexane, methylcyclohexane and dimethylcyclohexane. Typical examples of cyclic olefin hydrocarbons are those having 6 to 10 carbon atoms such as methylcyclopentene, cyclohexene, methylcyclohexene, and dimethylcyclohexene.

The present invention will also be useful for reforming under low-sulfur conditions using a variety of different reforming catalysts. Such catalyst include, but are not limited to Noble Group VIII metals on refractory inorganic oxides such as platinum on alumina, Pt/Sn on alumina and Pt/Re on alumina; Noble Group VIII metals on a zeolite such as Pt, Pt/Sn and Pt/Re on zeolites such as L-zeolites, ZSM-5, silicalite and beta; and Nobel Group VIII metals on alkali- and alkaline-earth exchanged L-Zeolites.

A preferred embodiment of the invention involves the use of a large-pore zeolite catalyst including an alkali or alkaline earth metal and charged with one or more Group VIII metals. Most preferred is the embodiment where such a catalyst is used in reforming a naphtha feed.

The term "large-pore zeolite" is indicative generally of a zeolite having an effective pore diameter of 6 to 15 Angstroms. Preferable large pore crystalline zeolites which are useful in the present invention include the type L zeolite, zeolite X, zeolite Y and faujasite. These have apparent pore sizes on the order to 7 to 9 Angstroms. Most preferably the zeolite is a type L zeolite.

The composition of type L zeolite expressed in terms of mole ratios of oxides, may be represented by the following formula:

$$(0.9\text{–}1.3)M_{2/n}O:AL_2O_3(5.2\text{–}6.9)SiO_2:yH_2O$$

In the above formula M represents a cation, n represents the valence of M, and y may be any value from 0 to about 9. Zeolite L, its X-ray diffraction pattern, its properties, and method for its preparation are described in detail in, for example, U.S. Pat. No. 3,216,789, the contents of which is hereby incorporated by reference. The actual formula may vary without changing the crystalline structure. For example, the mole ratio of silicon to aluminum (Si/Al) may vary from 1.0 to 3.5.

The chemical formula for zeolite Y expressed in terms of mole ratios of oxides may be written as:

$$(0.7\text{–}1.1)Na_2O:Al_2O_3:xSiO_2:yH_2O$$

In the above formula, x is a value greater than 3 and up to about 6. y may be a value up to about 9. Zeolite Y has a characteristic X-ray powder diffraction pattern which may be employed with the above formula for identification. Zeolite Y is described in more detail in U.S. Pat. No. 3,130,007 the contents of which is hereby incorporated by reference.

Zeolite X is a synthetic crystalline zeolitic molecular sieve which may be represented by the formula:

$$(0.7\text{–}1.1)M_{2/n}O:Al_2O_3:(2.0\text{–}3.0)SiO_2:yH_2O$$

In the above formula, M represents a metal, particularly alkali and alkaline earth metals, n is the valence of M, and y may have any value up to about 8 depending on the identity of M and the degree of hydration of the crystalline zeolite. Zeolite X, its X-ray diffraction pattern, its properties, and method for its preparation are described in detail in U.S.

Pat. No. 2,882,244 the contents of which is hereby incorporated by reference.

An alkali or alkaline earth metal is preferably present in the large-pore zeolite. That alkaline earth metal may be either barium, strontium or calcium, preferably barium. The alkaline earth metal can be incorporated into the zeolite by synthesis, impregnation or ion exchange. Barium is preferred to the other alkaline earths because it results in a somewhat less acidic catalyst. Strong acidity is undesirable in the catalyst because it promotes cracking, resulting in lower selectivity.

In another embodiment, at least part of the alkali metal can be exchanged with barium using known techniques for ion exchange of zeolites. This involves contacting the zeolite with a solution containing excess $Ba^{++}$ ions. In this embodiment the barium should preferably constitute from 0.1% to 35% by weight of the zeolite.

The large-pore zeolitic catalysts used in the invention are charged with one or more Group VIII metals, e.g., nickel, ruthenium, rhodium, palladium, iridium or platinum. The preferred Group VIII metals are iridium and particularly platinum. These are more selective with regard to dehydrocyclization and are also more stable under the dehydrocyclization reaction conditions than other Group VIII metals. If used, the preferred weight percentage of platinum in the catalyst is between 0.1% and 5%.

Group VIII metals are introduced into large-pore zeolites by synthesis, impregnation or exchange in an aqueous solution of appropriate salt. When it is desired to introduce two Group VIII metals into the zeolite, the operation may be carried out simultaneously or sequentially. To obtain a more complete understanding of the present invention, the following examples illustrating certain aspects of the invention are set forth. It should be understood, however, that the invention is not limited in any way to the specific details set forth therein.

EXAMPLES

High-temperature stress relief procedures applied to steel in air during construction of refinery reactor and furnace systems can produce oxide scales. Such oxide scales are reactive in carburizing environments. The following paragraphs examine the scales produced in typical oxidative treatments (an hour or two at 1650° F. in air); how these scales behave in carburizing environments; and how the scales respond to direct application of protective tin paint.

The materials investigated were samples of type 347 stainless steel prepared by heat treating in air in an electric furnace for one hour at 1650° F. Samples were treated for up to 2½ hours in air in both electric and flame-fired furnaces. These materials were examined as prepared in the oxidized state. Additional samples were exposed to carburizing conditions in a bench carburization apparatus for various durations of a few hours to one week at temperatures from 850° F. to 1200° F. Other samples were painted with protective tin paint, cured (reduced) and examined. Other protected samples were exposed to carburizing conditions at 1150° F. for up to two weeks.

Petrographic microscopy analysis revealed that the oxide scales that form at high temperature in air can be thick and complex. They typically consist of three layers. The outermost is hematite —Fe2O3; a middle layer is magnetite—Fe3O4; the innermost is ferrochromite—FeCr2O4. The magnetite may contain some chromium. The chromite layer may contain fine, nickel-rich metal inclusions. In a carburizing environment, the oxides largely become reduced to a fine-grained porous iron metal deposit which is extremely reactive and coke at temperatures as low as 850° F. For this reason, oxidized surfaces can result in serious coking problems.

A protective coating of, e.g., tin paint may be directly applied upon oxidized steel surfaces. The tin reacts with the iron in the oxide scale to form a coke-inhibiting layer of, e.g., iron stannide on chromium oxide. If the scale is not so thick that it completely consumes the tin, the remaining tin penetrates the chromium oxide layer to react with the steel surface.

The following paragraphs provide a description of various observations made when examining samples of 347 stainless steel which has been exposed to oxidizing and/or carburizing atmospheres. These observations are further illustrated in FIGS. 1–30. The above and other observations are illustrated below.

A 347 stainless steel furnace tube heat-treated at 1650° F. in air for 1 hour was cut into smaller pieces suitable for petrographic examination. A fresh sample was mounted in epoxy resin, ground, and polished for examination with petrographic and scanning electron microscopes.

Additional samples were tested in a bench carburization apparatus for various durations at 1000° F., 1025° F., 1050° F., 1150° F., and 1200° F. in an atmosphere of approximately 1% toluene in 7% propane in hydrogen. These samples were then prepared for petrographic microscopy analysis.

Another sample was tin-passivated using tin paint. The paint was allowed to dry overnight. The sample was then heated in 4% hydrogen in nitrogen at 200° F. per hour to 950° F. and held for 20 hours. This sample was then exposed to the carburizing atmosphere for two weeks at 1150° F. After one week, the carburization test was momentarily interrupted to examine the sample.

Figure 1:
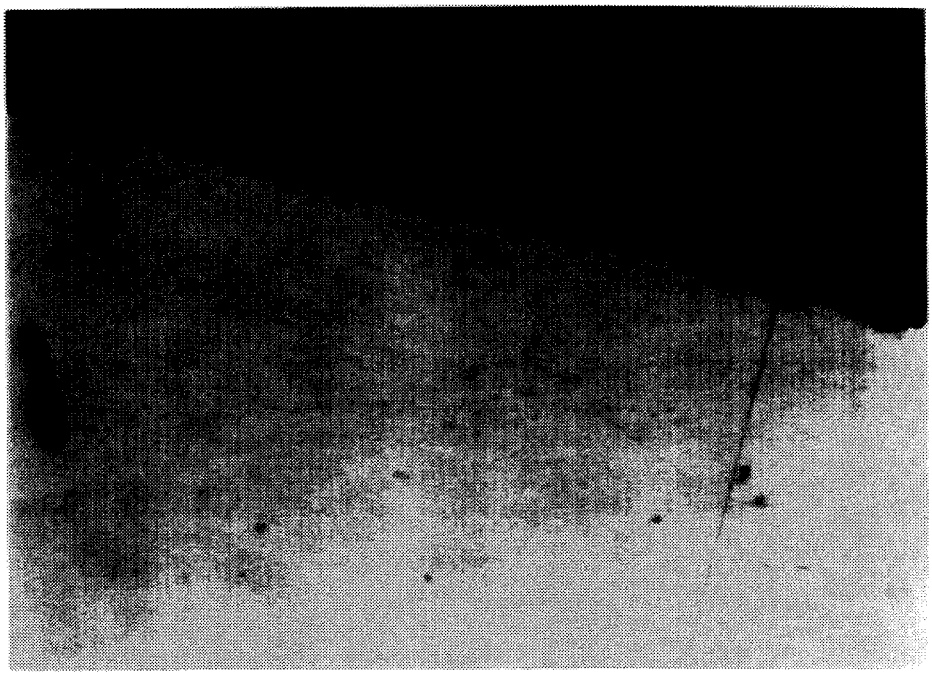
FIG. 1 is a photomicrograph (reflected lighted light: 200×. 1 cm=50 μm) of a surface of a 347 stainless steel sample which was heat treated in an electric furnace at 1650° F. air for 1 hour. The photomicrograph shows that the heat treatment in air produced a uniformly thin (5 μm) and adherent oxide coating.
Figure 2:
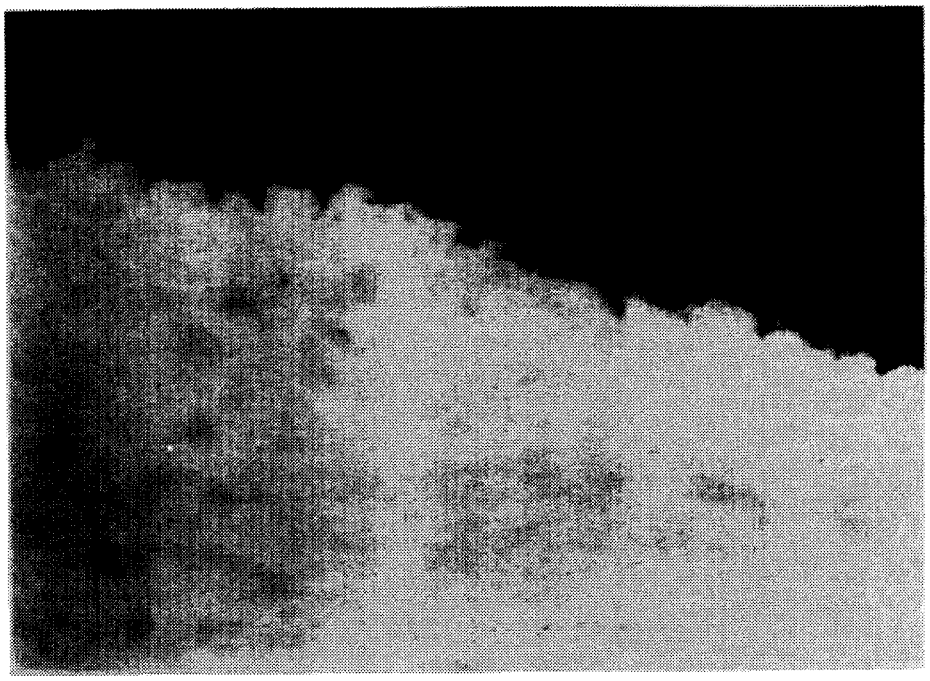
FIG. 2 is a photomicrograph (reflected light, 1250×, 1 cm=8 μm) of a surface of a 347 stainless steel sample which was heat treated in an electric furnace at 1650° F. in air for 1 hour. At high magnification, the complex oxide scale is shown. The inner dark band and crystals adjacent to the steel (bright) are composed of ferrochromite ($FeCr_2O_4$); the outer, brighter band is magnetite (essentially $Fe_3O_4$). The escalloped pattern on the steel surface results from a tendency of oxidation to preferentially attack grain boundaries.

Petrographic microscopy analysis of the fresh, heat-treated steel revealed uniformly thin (5 μm) and adherent oxide scales on the air-exposed surfaces (FIG. 1). At high magnification, a duplex scale consisting of a thin inner layer and scattered crystals of ferrochromite and a thicker outer layer of magnetite is shown (FIG. 2). The oxide scale shallowly penetrated the steel surface along grain boundaries producing an escalloped pattern.

SEM-EDX analyses showed that the steel surface was depleted in chromium and relatively enriched in nickel. Thus, it is believed that the composition would be more reactive in the carburizing environment an unoxidized normal type 347 stainless steel composition.

The alteration of the composition of the steel surface illustrates that the oxide scale is enriched in chromium and depleted in nickel. The weight % of Cr, Fe and Ni for each layer is set forth below.

| wt. % | Inner Oxide ($FeCr_2O_4$) | Outer Oxide ($Fe_3O_4$) |
|---|---|---|
| % Cr | 65.0 | 6.8 |
| Fe | 28.6 | 91.2 |
| Ni | 6.8 | 1.0 |

Figure 3:
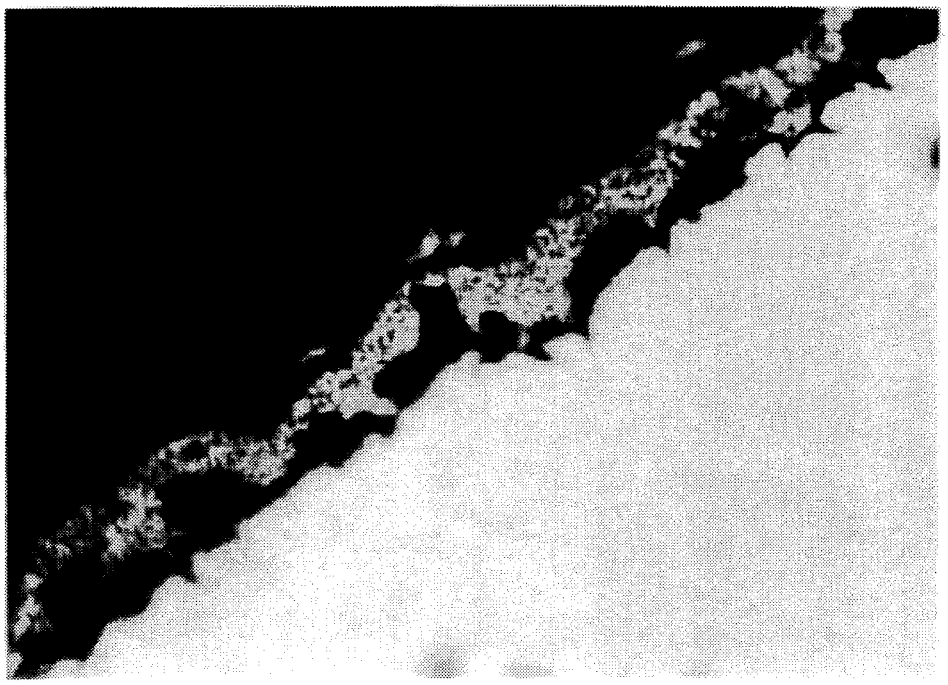
FIG. 3 is a photomicrograph (reflected light, 1250×, 1 cm=8 μm) of a surface of a 347 stainless steel sample which was heat treated in an electric furnace at 1650° F. in air for 1 hour. A sample treated for five days at 1000° F. in the carburizing atmosphere did not coke. Nevertheless, the magnetite band of the oxide coating was completely altered to finely porous iron metal, which should be extremely reactive in a carburizing environment. The ferrochromite (dark) was unaltered.
Figure 4:
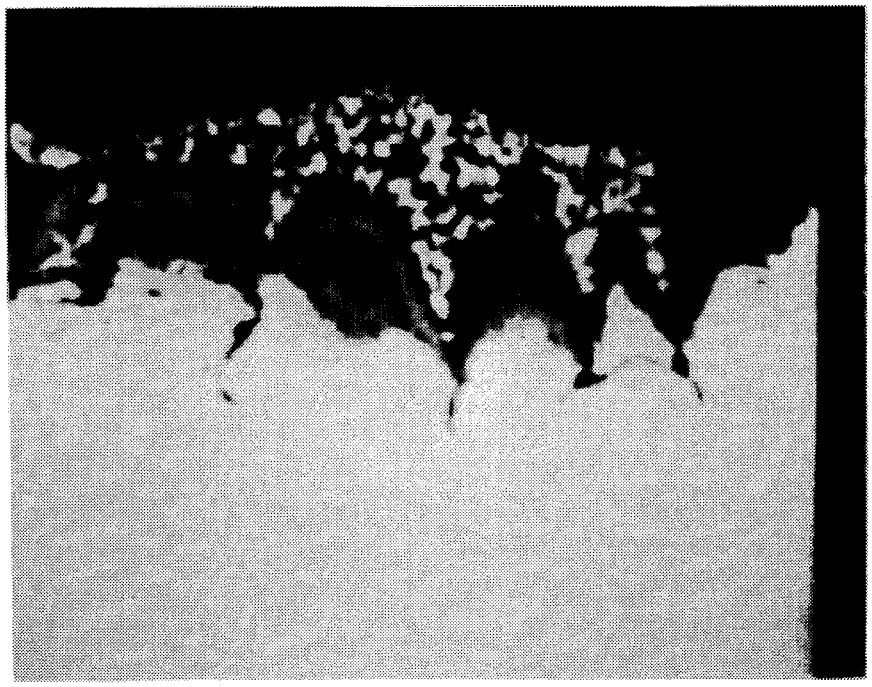
FIG. 4 is a photomicrograph (scale bar at right) of a surface of a 347 stainless steel sample which was heat treated in an electric furnace at 1650° F. in air for 1 hour. The photomicrograph is an SEM electron backscatter image of the sample run for 5 days at 1000° F.

A sample of this oxidized steel was exposed for 5 days at 1000° F. in the carburizing atmosphere. The sample did not coke in this test. The magnetite layer of the oxide scale was completely altered to porous, fine-grained iron metal (FIGS. 3 and 4).

Figure 5:
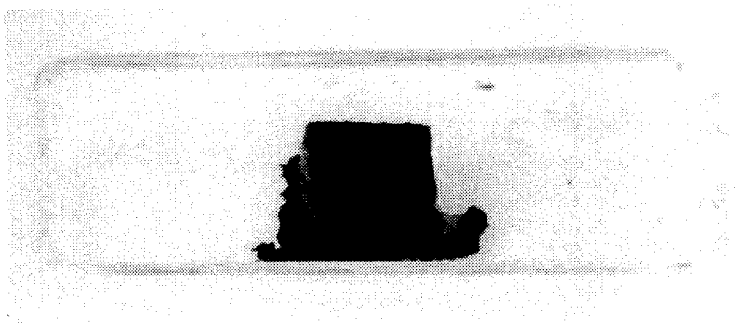
FIG. 5 is a photograph (approximately 2× magnification) of a sample of 347 stainless steel heat treated in an electric furnace at 1650° F. in air for 1 hour. The sample was exposed to a carburizing atmosphere for five hours at 1150° F. The sample coked abundantly on the oxidized surfaces but not on the unoxidized surfaces.

The tendency of oxide scales to reduce to fine reactive metal in the carburizing atmosphere is illustrated in FIG. 5.

After only five hours at 1150° F., the oxidized surfaces had coked abundantly, whereas the raw steel was merely slightly tarnished.

Figure 6:
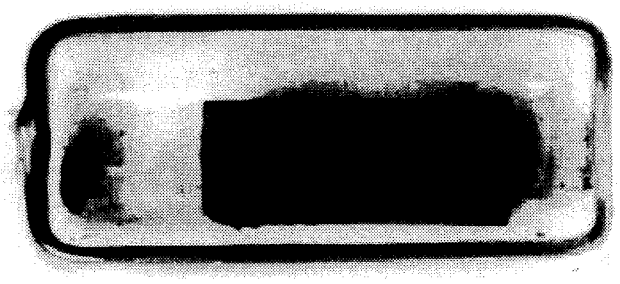
FIG. 6 is a photograph (approximately 2× magnification) of a sample of 347 stainless steel which was heat treated in an electric furnace at 1650° F. in air for 1 hour. The sample was exposed to a carburizing atmosphere for two weeks at 1150° F. A protective tin coating exhibited protection against coking and carburization.

A coating of tin paint provided protection against coking and carburization for two weeks at 1150° F. on all surfaces including the oxidized surfaces as shown in FIG. 6.

Figure 7:
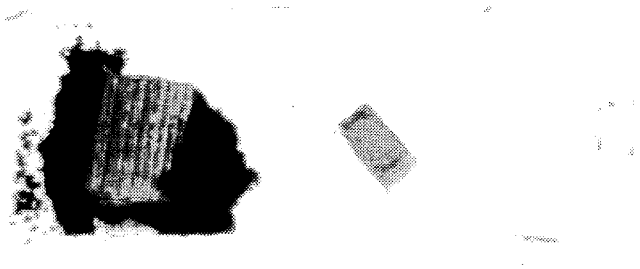
FIG. 7 is a photograph of a sample of 347 stainless steel which was heat treated in an electric furnace at 1650° F. in air for 1 hour. The sample coked severely on the oxidized surfaces after only 24 hours at 1025° F. in a carburizing atmosphere. The chip at right is raw 347 stainless steel.
Figure 8:
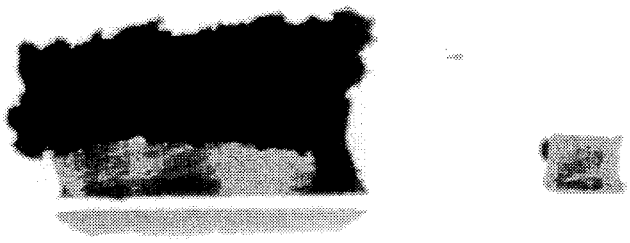
FIG. 8 is a photograph of a surface of a 347 stainless steel sample which was heat treated in an electric furnace at 1650°

Similar vigorous coking on oxidized surfaces was observed on samples exposed to the carburizing atmosphere for 25 hours at 1025° F. and for 2½ hours at 1200° F. (FIGS. 7 and 8).

A photomicrograph of a sample exposed to the carburizing atmosphere at 1200° F. (FIG. 9) shows not only that the iron oxide had completely decomposed but that pitting and carburization attack had locally occurred on the underlying steel itself. This shows that an oxide scale or accumulation of oxide particulates can infect an otherwise resistant steel with a coking problem. The raw surfaces of this sample were merely tarnished. At high magnification, it is shown that the chromium-rich oxide persists and continues to offer some protection to the steel (FIG. 10).

FIGS. 11 and 12 show at high magnification how the tin paint had reacted with the oxidized and raw steel surfaces, respectively, through the reduction step. FIG. 11 shows that the iron oxide layer had thoroughly reacted with the tin to produce a series of iron stannide compounds. The layer and crystals of ferrochromite persisted under the stannide. Some excess tin remained on top of the stannide. SEM-EDX analysis of the ferrochromite gave:

| | |
|---|---|
| % Cr | 58.7 |
| Fe | 30.4 |
| Ni | 2.3 |
| Nb | 4.1 |
| No | 0.2 |
| Sn | 6.9 |

On the raw steel surface (FIG. 12), a smooth, continuous layer of stannide (two phases) about 4 μm thick formed.

Because the stannide had not directly coated the steel on the oxidized surface, it was thought that direct application of the protective tin paint to an oxidized surface might not be practical. Surprisingly, it worked very well. Even more surprisingly, after two weeks at 1150° F. in the carburizing atmosphere, the stannide layer had migrated through the ferrochromite layer to attack the steel surface beneath, resulting in a continuous coating of stannide directly on the steel (FIGS. 13, 15 and 16). Most of the ferrochromite had been reduced to eskolaite ($Cr_2O_3$). This experiment also showed that both the eskolaite and the stannide inhibit coking. SEM-EDX analysis of the eskolaite gave:

| | |
|---|---|
| % Cr | 72.7 |
| Fe | 7.1 |
| Ni | 1.3 |
| Nb | 15.5 |
| Mo | 0.0 |
| Sn | 9.2 |

FIG. 14 shows that direct application of tin paint to a raw steel surface produces a smooth and continuous stannide coating on the steel. This coating was about 15 μm thick after two weeks in the carburizing atmosphere at 1150° F. Some differences in the thickness of stannide layers on different samples was expected. However, most of the variation in thickness on this sample is believed to be a result of various degrees of reaction of available tin with the underlying steel (compare FIG. 12).

Samples of 347 stainless steel furnace tube that had been heat-treated in air in a gas-fired furnace for 2½ hours were examined after exposure to a carburizing atmosphere of approximately 1% toluene in 7% propane in hydrogen for three hours at 1050° F. Another sample had one oxidized surface and four raw surfaces painted with a ferruginous tin paint with $Fe_2O_3$—and the other oxidized surface painted with plain tin paint—PM 300 A2. The ferruginous paint had been reduced in 50/50 $H_2N_2$ at 950° F. The plain tin paint was not reduced prior to exposure to the carburizing atmosphere. The sample was then treated in the carburizing atmosphere at 1150° F. for five days.

FIGS. 17 and 18 show that the heat treatment produced a thicker and more complicated oxide scale than the previous treatment. The scale averaged about 40 μm in thickness. It consisted of an outer layer of hematite—$Fe_2O_3$; a middle layer of magnetite—$Fe_3O_4$; an inner layer of ferrochromite shot with fine (<1 μm grains) nickel-rich metal; and a thin, innermost layer of pure ferrochromite. The clouds of metal grains in the ferrochromite layer are believed to be the result of low-temperature decomposition of a wüstite-type phase. A chromium depleted, nickel enriched zone at the surface of the steel in this sample was not detected as with the oxidized sample. SEM-EDX analyses of the oxides gave:

| wt. % | Ferrochromite | Magnetite | Hematite |
|---|---|---|---|
| Cr | 48.2 | 1.2 | 0.5 |
| Fe | 44.7 | 98.6 | 99.8 |
| Ni | 5.9 | 0.2 | 0.0 |
| Nb | 0.8 | 0.0 | 0.0 |
| Mo | 0.9 | 0.5 | 0.0 |

The oxidized surfaces coked profusely after only three hours at 1050° F. (FIG. 19). A little coking also occurred on adjacent raw surfaces. Surprisingly, however, the tin paint provided nearly complete protection against coking and carburization after five days at 1150° F. (FIG. 20).

The underside of the sample in FIG. 20 had been painted with plain tin paint. A photomicrograph (FIG. 21) shows that the resulting stannide effectively coated and veined the ferrochromite layer, sealing off the reactive nickel-rich metal particles and protecting the underlying steel.

The upper side of the sample in FIG. 20 had been painted with a ferruginous variety of the tin paint, which contained 5% fine powdered $Fe_2O_3$. Unexpectedly, we have observed that the presence of some fine-grained iron oxide helps the tin in the paint react with stainless steel, producing thicker coatings of stannide.

FIG. 22 shows that stannide had effectively coated most of the ferrochromite. However, locally the stannide coating was breached exposing the underlying ferrochromite and steel to the carburizing atmosphere. Active coating at these localities peeled back some of the protective stannide, exposing more of the steel to attack.

At high magnification in FIG. 23, it is shown that the plain tin paint was able to penetrate the ferrochromite layer to produce a continuous stannide coating directly on the steel. In FIG. 24, it is shown that some stannide formed directly on the steel surface but it is mostly spotty and discontinuous.

The above results show that it is possible to directly apply the protective tin paint directly to a thick layer of oxide on steel, but it is preferred that the oxide not be so thick that it overwhelms the tin in the paint. Thus, it is preferred to apply enough tin to react with the underlying steel itself. These results also demonstrate that with abundant iron in an oxide scale, it is not necessary to add iron oxide to the paint formula.

A 347 stainless steel furnace tube sample was heat treated in air and $N_2$ for 2½ hours in an electric furnace and exposed to a carburizing atmosphere of approximately 1% toluene in 7% propane in hydrogen at 900° F. for 5 days.

A fresh, heat-treated steel sample revealed a thick, complex oxide scale on the air-exposed surface (FIGS. 25 and 27). A nitrogen-exposed surface had a trace of oxide and chloride attack (FIGS. 26 and 28) and, more curiously, a ten μm edge zone enriched in scattered chromium-rich carbide grains. Some carbides or possibly nitrides also occur scattered along the surface of the steel. Similar carbides had appeared in a sample of stainless steel heated in air at 1300° F. for 24 hours. These carbides were attributed to reaction with $CO_2$.

A sample of heat-treated steel was exposed to the carburizing atmosphere at 900° F. for five days. Some coking and dusting was observed on the oxidized surface (FIGS. 29 and 30). FIG. 30 shows that the oxide was initially reduced to finely porous iron metal which then reacted with the carburizing atmosphere.

Conclusions

The oxide scales that form on steels at high temperature in air can be thick and complex. They typically consist of three layers. The outermost is hematite—$Fe_2O_3$; a middle layer is magnetite—$Fe_3O_4$; the innermost is ferrochromite—$FeCr_2O_4$. The magnetite may contain some chromium. The chromite layer may contain fine, nickel-rich metal inclusions. In a carburizing environment, the oxides largely become reduced to fine-grained iron metal which is extremely reactive and cokes at temperatures as low as 850° F. For this reason, oxidized surfaces can result in serious coking problems resulting from carburization.

By applying a protective coating of, e.g., tin paint directly upon an oxidized steel surface, the coating reacts with the iron in the oxide scale to form a carburization inhibiting layer of iron stannide on chromium oxide. If the scale is not so thick that it completely consumes the tin, the remaining tin penetrates the chromium oxide layer to react with the steel surface. A continuous layer of protective stannide can form on the steel this way.

While the invention has been described above in terms of preferred embodiments, it is to be understood that variations and modifications may be used. Such variations and modifications to the above preferred embodiments which will be readily evident to those skilled in the art, and which are to be considered within the scope of the invention as defined by the following claims.

What is claimed is:

1. A method for reforming hydrocarbons comprising (i) treating oxide scales in a reforming reactor system, at least one surface thereof to be exposed to hydrocarbons, by coating at least a portion of the surface of said oxide scales with a material resistant to carburization, reacting said material with metal oxide on said surface and fixating or removing at least a portion of said metal oxide from the reactor system, and (ii) reforming hydrocarbons in said reactor system under conditions effective for reforming those hydrocarbons and conditions of low sulfur.

2. The method for reforming hydrocarbons according to claim 1, wherein at least a portion of said oxide scales comprises a hematite outermost layer, a magnetite middle layer and a ferrochromite innermost layer.

3. The method for reforming hydrocarbons according to claim 1, wherein said reforming step comprises reforming in the presence of a large-pore zeolite catalyst including an alkali or alkaline earth metal and charged with one or more Group VIII metals.

4. The method for reforming hydrocarbons according to claim 3, wherein a naphtha feed is contacted with a large-pore zeolite catalyst including an alkali or alkaline earth metal and charged with one or more Group VIII metals, and wherein at least a portion of the reactor system has a resistance to carburization greater than mild steel under conditions of low sulfur.

5. The method for reforming hydrocarbons according to claim 1, comprising reforming in a reactor system, at least a portion thereof having a resistance to carburization greater than mild steel, under conditions of low sulfur.

6. The method for reforming hydrocarbons according to claim 1, comprising reforming in a reactor system, at least a portion thereof having a resistance to carburization greater than aluminized steels, under conditions of low sulfur.

7. The method for reforming hydrocarbons according to claim 1, comprising reforming in a reactor system, at least a portion thereof having a resistance to carburization greater than alloy steels, under conditions of low sulfur.

8. The method for reforming hydrocarbons according to claim 1, wherein said reforming step comprises reforming in the presence of an L-zeolite charged with a Group VIII nobel metal.

9. The method for reforming hydrocarbons according to claim 8, wherein said Group VIII metal is platinum.

10. A method for reforming hydrocarbons comprising (i) treating a reforming reactor system, at least one surface thereof to be exposed to hydrocarbons, by coating at least a portion of oxide scales having two or more oxide layers on the surface of said reforming reactor system with a material more resistant to carburization than said oxide scales prior to coating, reacting said material with metal oxide in said oxide scales and fixating or removing at least a portion of the oxide in said metal oxide from the reactor system and (ii) reforming hydrocarbons in said reactor system under conditions effective for reforming those hydrocarbons.

11. The method for reforming hydrocarbons according to claim 10, wherein at least a portion of said oxide scales comprises a hematite layer and a magnetite layer.

12. The method for reforming hydrocarbons according to claim 11, wherein at least a portion of said oxide scales comprises a ferrochromite layer.

13. The method for reforming hydrocarbons according to claim 10, wherein said carburization resistant material is selected from at least one member of the group consisting of copper, tin, arsenic, antimony, bismuth, chromium, germanium, indium, selenium, tellurium and brass.

14. The method for reforming hydrocarbons according to claim 13, wherein said carburization resistant material is selected from at least one member of the group consisting of tin, arsenic, antimony and bismuth.

15. The method for reforming hydrocarbons according to claim 14, wherein said carburization resistant material comprises tin.

16. The method for reforming hydrocarbons according to claim 13, wherein said carburization resistant material comprises chromium.

17. The method for reforming hydrocarbons according to claim 10, wherein said material is provided as a plating, cladding, paint or other coating, to a base construction material.

18. The method for reforming hydrocarbons according to claim 10, wherein said material more resistant to carburization is a tin coating applied by electroplating, vapor deposition, or soaking in a molten bath.

19. The method for reforming hydrocarbons according to claim 10, wherein said material is effective for retaining its resistance to carburization after oxidation.

20. The method for reforming hydrocarbons according to claim 10, wherein said reforming step comprises reforming in the presence of a large-pore zeolite catalyst.

21. The method for reforming hydrocarbons according to claim 20, wherein said large-pore zeolite catalyst comprises an L-zeolite charged with a Group VIII noble metal.

22. The method for reforming hydrocarbons according to claim 21, wherein said Group VIII metal is platinum.

23. A method for protecting a metal surface having oxide scales comprising (i) treating a reactor system, at least one surface thereof to be exposed to hydrocarbons, by coating at least a portion of oxide scales having two or more oxide layers on the surface of said reactor system with a material more resistant to carburization than said oxide scales prior to coating, reacting said material with metal oxide in said oxide scales and fixating or removing at least a portion of the oxide in said metal oxide from the reactor system, and (ii) reacting hydrocarbons in said reactor system under conditions effective for reacting those hydrocarbons.

24. The method according to claim 23, wherein said carburization resistant material is selected from at least one member of the group consisting of copper, tin, arsenic, antimony, bismuth, chromium, germanium, indium, tellurium and brass.

25. The method according to claim 24, wherein said carburization resistant material comprises tin.

26. A method for catalytically reforming hydrocarbons to form aromatics, said method comprising (i) coating at least an oxidized steel surface portion of a reforming reactor system to be contacted by hydrocarbons with a tin-containing paint, (ii) heating the coated surface in a reducing atmosphere to produce a carburization resistant surface comprising a stannide, and (iii) reforming hydrocarbons in said reactor system under conditions of low sulfur.

27. The method for reforming hydrocarbons according to claim 26, wherein said reforming comprises reforming in the presence of an L-zeolite catalyst.

28. The method for reforming hydrocarbons according to claim 27, wherein said L-zeolite catalyst is charged with a Group VIII noble metal.

29. The method for reforming hydrocarbons according to claim 28, wherein said Group VIII metal is platinum.

30. The method for reforming hydrocarbons according to claim 26, wherein said oxidized steel surface comprises metal oxide in the form of scales.

31. The method for reforming hydrocarbons according to claim 30, wherein said scales have two or more oxide layers.

32. The method for reforming hydrocarbons according to claim 31, wherein said oxide scales comprise a hematite outermost layer, a magnetite middle layer and a ferrochromite innermost layer.

33. The method according to claim 26, wherein said paint comprises (i) a hydrogen decomposable tin compound, (ii) a solvent system, (iii) a finely divided tin metal and (iv) tin oxide.

34. The method according to claim 26, wherein said carburization resistant surface comprises iron stannide.

35. The method according to claim 26, wherein said heating said coated surface in a reducing atmosphere to produce a carburization resistant surface occurs prior to subjecting said coated surface to a carburizing atmosphere.

36. The method according to claim 26, wherein said heating said coated surface in a reducing atmosphere to produce a carburization resistant surface occurs under reforming process conditions.

37. A method for catalytically reforming hydrocarbons to form aromatics, said method comprising (i) coating at least a portion of an oxidized steel surface in a reforming reactor system, said surface to be contacted by hydrocarbons, with a coating material containing a metal or metal compound which when in contact with said oxidized steel surface in a reducing atmosphere will form a surface which is more resistant to carburization than said oxidized steel surface, (ii) heating the coated surface in a reducing atmosphere to form a carburization resistant surface and (iii) reforming hydrocarbons in said reactor system under conditions of low sulfur.

38. The method for reforming hydrocarbons according to claim 37, wherein said reforming comprises reforming in the presence of an L-zeolite catalyst.

39. The method for reforming hydrocarbons according to claim 38, wherein said L-zeolite catalyst is charged with a Group VIII noble metal.

40. The method for reforming hydrocarbons according to claim 39, wherein said Group VIII metal is platinum.

41. The method for reforming hydrocarbons according to claim 37, wherein said oxidized steel surface comprises metal oxide in the form of scales.

42. The method for reforming hydrocarbons according to claim 41, wherein said scales have two or more oxide layers.

43. The method for reforming hydrocarbons according to claim 42, wherein said oxide scales comprise a hematite outermost layer, a magnetite middle layer and a ferrochromite innermost layer.

44. The method according to claim 37, wherein said heating said coated surface in a reducing atmosphere to produce a carburization resistant surface occurs prior to subjecting said coated surface to a carburizing atmosphere.

45. The method according to claim 37, wherein said heating said coated surface in a reducing atmosphere to produce a carburization resistant surface occurs under reforming process conditions.

46. The method for reforming hydrocarbons according to claim 37, wherein said coating material comprises tin, arsenic, antimony or bismuth.

47. The method for reforming hydrocarbons according to claim 46, wherein said coating material comprises tin.

48. The method for reforming hydrocarbons according to claim 47, wherein said carburization resistant surface comprises an iron stannide.

* * * * *